US011905582B2

(12) United States Patent
Na et al.

(10) Patent No.: US 11,905,582 B2
(45) Date of Patent: Feb. 20, 2024

(54) BULK NICKEL-NIOBIUM-PHOSPHORUS-BORON GLASSES BEARING LOW FRACTIONS OF CHROMIUM AND EXHIBITING HIGH TOUGHNESS

(71) Applicant: Glassimetal Technology, Inc., Pasadena, CA (US)

(72) Inventors: Jong Hyun Na, Pasadena, CA (US); Kyung-Hee Han, Pasadena, CA (US); Maximilien Launey, Pasadena, CA (US); Marios D. Demetriou, West Hollywood, CA (US); William L. Johnson, San Marino, CA (US)

(73) Assignee: Glassimetal Technology, Inc., Pasadena, CA (US)

( * ) Notice: Subject to any disclaimer, the term of this patent is extended or adjusted under 35 U.S.C. 154(b) by 397 days.

(21) Appl. No.: 15/916,046

(22) Filed: Mar. 8, 2018

(65) Prior Publication Data

US 2018/0258516 A1 Sep. 13, 2018
US 2019/0218649 A9 Jul. 18, 2019

Related U.S. Application Data

(60) Provisional application No. 62/469,348, filed on Mar. 9, 2017.

(51) Int. Cl.
*C22C 45/04* (2006.01)

(52) U.S. Cl.
CPC ..... *C22C 45/04* (2013.01); *C22C 2200/02* (2013.01)

(58) Field of Classification Search
CPC ..... C22C 45/00; C22C 45/008; C22C 45/04; C22C 19/00; C22C 19/03; C22C 19/05; C22C 19/058
See application file for complete search history.

(56) References Cited

U.S. PATENT DOCUMENTS

| | | | |
|---|---|---|---|
| 3,856,513 | A | 12/1974 | Chen et al. |
| 4,116,682 | A | 9/1978 | Polk et al. |
| 4,126,284 | A | 11/1978 | Ichikawa et al. |
| 4,144,058 | A | 3/1979 | Chen et al. |
| 4,152,144 | A | 5/1979 | Hasegawa et al. |
| 4,385,932 | A | 5/1983 | Inomata et al. |
| 4,385,944 | A | 5/1983 | Hasegawa |
| 4,582,536 | A | 4/1986 | Raybould |

(Continued)

FOREIGN PATENT DOCUMENTS

| | | |
|---|---|---|
| CN | 1354274 | 6/2002 |
| CN | 1653200 | 8/2005 |

(Continued)

OTHER PUBLICATIONS

Habazaki et al., "Corrosion behaviour of amorphous Ni—Cr—Nb—P—B bulk alloys in 6M Hci solution," *Material Science and Engineering*, A318, 2001, pp. 77-86.

(Continued)

*Primary Examiner* — John A Hevey

(57) ABSTRACT

Ni—Cr—Nb—P—B alloys optionally bearing Si and metallic glasses formed from said alloys are disclosed, where the alloys have a critical rod diameter of at least 5 mm and the metallic glasses demonstrate a notch toughness of at least 96 MPa $m^{1/2}$.

10 Claims, 18 Drawing Sheets

(56) References Cited

U.S. PATENT DOCUMENTS

| | | | | |
|---|---|---|---|---|
| 4,892,628 | A | 1/1990 | Guilinger | |
| 4,900,638 | A | 2/1990 | Emmerich | |
| 4,968,363 | A | 11/1990 | Hashimoto et al. | |
| 5,158,229 | A | 10/1992 | Bose et al. | |
| 5,338,376 | A | 8/1994 | Liu et al. | |
| 5,429,725 | A | 7/1995 | Thorpe et al. | |
| 5,634,989 | A | 6/1997 | Hashimoto et al. | |
| 6,004,661 | A | 12/1999 | Sakai et al. | |
| 6,303,015 | B1 | 10/2001 | Thorpe et al. | |
| 6,325,868 | B1 | 12/2001 | Kim et al. | |
| 6,695,936 | B2 | 2/2004 | Johnson | |
| 8,052,923 | B2 | 11/2011 | Langlet | |
| 8,287,664 | B2 | 10/2012 | Brunner | |
| 9,085,814 | B2 | 7/2015 | Na et al. | |
| 9,556,504 | B2 | 1/2017 | Na et al. | |
| 9,863,024 | B2 | 1/2018 | Na et al. | |
| 10,000,834 | B2 | 6/2018 | Na et al. | |
| 2005/0263216 | A1 | 12/2005 | Chin et al. | |
| 2006/0213586 | A1 | 9/2006 | Kui | |
| 2007/0175545 | A1 | 8/2007 | Urata et al. | |
| 2009/0110955 | A1 | 4/2009 | Hartmann et al. | |
| 2010/0028716 | A1 | 2/2010 | Nuetzel et al. | |
| 2012/0073710 | A1 | 3/2012 | Kim et al. | |
| 2012/0168037 | A1 | 7/2012 | Demetriou et al. | |
| 2013/0048152 | A1* | 2/2013 | Na | C22C 1/002 148/403 |
| 2013/0263973 | A1 | 10/2013 | Kurahashi et al. | |
| 2014/0076467 | A1 | 3/2014 | Na et al. | |
| 2014/0096873 | A1 | 4/2014 | Na et al. | |
| 2014/0116579 | A1 | 5/2014 | Na et al. | |
| 2014/0130942 | A1 | 5/2014 | Floyd et al. | |
| 2014/0130945 | A1 | 5/2014 | Na et al. | |
| 2014/0190593 | A1 | 7/2014 | Na et al. | |
| 2014/0202596 | A1* | 7/2014 | Na | C22C 45/003 148/538 |
| 2014/0213384 | A1 | 7/2014 | Johnson et al. | |
| 2014/0238551 | A1 | 8/2014 | Na et al. | |
| 2015/0047755 | A1 | 2/2015 | Na et al. | |
| 2015/0158126 | A1 | 6/2015 | Hartmann et al. | |
| 2015/0159240 | A1* | 6/2015 | Na | C22C 45/008 148/540 |
| 2015/0159242 | A1* | 6/2015 | Na | C22C 19/058 148/555 |
| 2015/0176111 | A1* | 6/2015 | Na | C22C 1/002 148/403 |
| 2015/0197837 | A9 | 7/2015 | Schramm et al. | |
| 2015/0240336 | A1 | 8/2015 | Na et al. | |
| 2016/0047023 | A1 | 2/2016 | Na et al. | |
| 2016/0060739 | A1 | 3/2016 | Na et al. | |
| 2016/0090644 | A1 | 3/2016 | Na et al. | |

FOREIGN PATENT DOCUMENTS

| | | |
|---|---|---|
| DE | 3929222 | 3/1991 |
| DE | 10 2011 001783 | 10/2012 |
| DE | 102011001784 | 10/2012 |
| EP | 0014335 | 8/1980 |
| EP | 0161393 | 11/1985 |
| EP | 0260706 | 3/1988 |
| EP | 1077272 | 2/2001 |
| EP | 1108796 | 6/2001 |
| EP | 1522602 | 4/2005 |
| JP | S54 76423 | 6/1979 |
| JP | S55-148752 | 11/1980 |
| JP | S57-13146 | 1/1982 |
| JP | 60-2641 | 1/1985 |
| JP | 63-079930 | 4/1988 |
| JP | 63-079931 | 4/1988 |
| JP | S63 277734 | 11/1988 |
| JP | H01 205062 | 8/1989 |
| JP | 08-269647 | 10/1996 |
| JP | 11-71659 | 3/1999 |
| JP | 2001-049407 | 2/2001 |
| JP | 2007-075867 | 3/2007 |
| WO | WO 2012/053570 | 4/2012 |
| WO | WO 2013/028790 | 2/2013 |

OTHER PUBLICATIONS

Murakami (Editor), *Stress Intensity Factors Handbook*, vol. 2, Oxford: Pergamon Press, 1987, 4 pages.

Yokoyama et al., "Viscous Flow Workability of Ni—Cr—P—B Metallic Glasses Produced by Melt-Spinning in Air," Materials Transactions, vol. 48, No. 12, 2007, pp. 3176-3180.

Park T. G. et al., "Development of new Ni-based amorphous alloys containing no metalloid that have large undercooled liquid regions," Scripta Materialia, vol. 43, No. 2, 2000, pp. 109-114.

Mitsuhashi A. et al., "The corrosion behavior of amorphous nickel base alloys in a hot concentrated phosphoric acid," Corrosion Science, vol. 27, No. 9, 1987, pp. 957-970.

Kawashima A. et al., "Change in Corrosion behavior of amorphous Ni—P alloys by alloying with chromium, molybdenum or tungsten," *Journal of Non-Crystalline Solids*, vol. 70, No. 1, 1985, pp. 69-83.

Abrosimova G. E. et al., "Phase segregation and crystallization in the amorphous alloy Ni70Mo10P20," *Physics of the Solid State*, vol. 40., No. 9, 1998, pp. 1429-1432.

Yokoyama M. et al., "Hot-press workability of Ni-based glassy alloys in supercooled liquid state and production of the glassy alloy separators for proton exchange membrane fuel cell," *Journal of the Japan Society of Powder and Powder Metallurgy*, vol. 54, No. 11, 2007, pp. 773-777.

Rabinkin et al., "Brazing Stainless Steel Using New MBF-Series of Ni—Cr—B—Si Amorphous Brazing Foils: New Brazing Alloys Withstand High-Temperature and Corrosive Environments," *Welding Research Supplement*, 1998, pp. 66-75.

Chen S.J. et al., "Transient liquid-phase bonding of T91 steel pipes using amorphous foil," Materials Science and Engineering A, vol. 499, No. 1-2, 2009, pp. 114-117.

Hartmann, Thomas et al., "New Amorphous Brazing Foils for Exhaust Gas Application," Proceedings of the 4th International Brazing and Soldering Conference Apr. 26-29, 2009, Orlando, Florida, USA.

Habazaki et al., "Preparation of corrosion-resistant amorphous Ni—Cr—P—B bulk alloys containing molybdenum and tantalum," *Material Science and Engineering*, A304-306, 2001, pp. 696-700.

Zhang et al., "The Corrosion Behavior of Amorphous Ni—Cr—P Alloys in Concentrated Hydrofluoric Acid," Corrosion Science, vol. 33, No. 10, pp. 1519-1528, 1992.

Katagiri et al., "An attempt at preparation of corrosion-resistant bulk amorphous Ni—Cr—Ta-Mo—P—B alloys," *Corrosion Science*, vol. 43, No. 1, pp. 183-191, 2001.

* cited by examiner

BULK NICKEL-NIOBIUM-PHOSPHORUS-BORON GLASSES BEARING LOW FRACTIONS OF CHROMIUM AND EXHIBITING HIGH TOUGHNESS

CROSS-REFERENCE TO RELATED PATENT APPLICATION

This patent application claims the benefit under 35 U.S.C. § 119(e) of U.S. Patent Application No. 62/469,348, entitled "BULK NICKEL-NIOBIUM-PHOSPHORUS-BORON GLASSES BEARING LOW FRACTIONS OF CHROMIUM AND EXHIBITING HIGH TOUGHNESS," filed on Mar. 9, 2017, which is incorporated herein by reference in its entirety.

TECHNICAL FIELD

The disclosure relates to Ni—Nb—P—B alloys bearing low fractions of Cr and optionally Si that are capable of forming a metallic glass in bulk dimensions, and wherein the metallic glasses demonstrates a high toughness.

BACKGROUND

Ni—Cr—Nb—P—B alloys optionally bearing Si capable of forming bulk metallic glass rods with critical rod diameters greater than 3 mm have been disclosed in U.S. patent application Ser. No. 13/592,095, entitled "Bulk Nickel-Based Chromium and Phosphorus Bearing Metallic Glasses," filed on Aug. 22, 2012, and issued as U.S. Pat. No. 9,085,814 on Jul. 21, 2015, the disclosure of which is incorporated herein by reference in its entirety. In this application it is also shown that within the disclosed range the toughness varies with the Cr content, attaining a peak of 94.56 MPa $m^{1/2}$ over a very narrow range around 5 atomic percent Cr. The toughness drops significantly when the Cr content varies above or below the 5 atomic percent. This peak in toughness however comes at the expense of glass-forming ability, as the single alloy demonstrating the peak toughness has a critical rod diameter of just 5 mm.

Ni—Cr—Nb—P—B alloys optionally bearing Si capable of forming bulk metallic glass rods with critical rod diameters of at least 3 mm have been disclosed in U.S. patent application Ser. No. 14/540,815, entitled "Bulk Nickel-Chromium-Phosphorus Glasses Bearing Niobium and Boron Exhibiting High Strength and/or High Thermal Stability of the Supercooled Liquid Region," filed on Nov. 13, 2014 and issued as U.S. Pat. No. 10,000,834 on Jun. 19, 2018, the disclosure of which is incorporated herein by reference in its entirety. In this application it is also shown that toughness increases as the atomic concentration of B drops below 3 atomic percent, but the increase in toughness comes at the expense of glass-forming ability. Specifically, a very narrow range is presented where notch toughness and critical rod diameter are both high, where a single alloy demonstrates a notch toughness of 95.1 MPa $m^{1/2}$ and a critical rod diameter of 6 mm. When the B content varies above or below that value, either toughness or glass-forming ability drops significantly.

Ni—Cr—Nb—P—B alloys optionally bearing Si capable of forming bulk metallic glass rods have also been disclosed in U.S. patent application Ser. No. 14/067,521, entitled "Bulk Nickel-Based Chromium and Phosphorus Bearing Metallic Glasses with High Toughness," filed on Oct. 30, 2013 and issued as U.S. Pat. No. 9,863,024 on Jan. 9, 2018, the disclosure of which is incorporated herein by reference in its entirety. A combination of high glass-forming ability and high toughness is achieved within a range of Nb and Cr concentrations, where critical rod diameters exceed 6 mm and notch toughness values exceed 70 MPa $m^{1/2}$. Alloys in the disclosed range demonstrate a notch toughness greater than 70 MPa $m^{1/2}$ and up to 85.5 MPa $m^{1/2}$, and a critical rod diameter greater than 6 mm and up to 11 mm.

The Ser. Nos. 13/592,095 and 14/540,815 applications therefore disclose Ni—Cr—Nb—P—B alloys optionally bearing Si with toughness varying sharply with composition, demonstrating a peak of about 95 MPa $m^{1/2}$ over a very narrow range, while the alloys that demonstrate the peak toughness of about 95 MPa $m^{1/2}$ have a critical rod diameter limited to 5-6 mm. On the other hand, the Ser. No. 14/067,521 application discloses Ni—Cr—Nb—P—B alloys optionally bearing Si that have both a high toughness and a high glass-forming ability over a broader region. While the glass-forming ability extends to as high as 11 mm, the notch toughness is limited to about 85 MPa $m^{1/2}$.

There still remains a need to identify a compositional range of Ni—Cr—Nb—P—B alloys optionally bearing Si where the alloys demonstrate very high toughness and good glass-forming ability over a fairly broad compositional range.

BRIEF SUMMARY

The disclosure is directed to Ni—Cr—Nb—P—B alloys and metallic glasses, where over the disclosed range the alloys demonstrate good glass-forming ability while the metallic glasses formed from the alloys demonstrate a high toughness. Specifically, the alloys of the disclosure demonstrate a critical rod diameter in excess of 5 mm, while the metallic glasses formed from the alloys demonstrate a notch toughness greater than 95 MPa $m^{1/2}$.

In one embodiment, the disclosure is directed to an alloy capable of forming a metallic glass represented by the following formula (subscripts w, x, y, and z denote deviations from a nominal concentration in atomic percentages, while a denotes an atomic fraction):

$$Ni_{(95-w-x-y-z)}Cr_{2+w}Nb_{3+x}(P_{1-a}Si_a)_yB_z \quad \text{Eq. (1)}$$

where:

$-1.5 \le w < 0.5$;

$-0.5 \le x \le 1$;

$2.6 \le z \le 4$;

$20.2+0.2w-0.65|x|-z \le y \le 20.8-z$;

$0 \le a \le 0.1$;

where the critical rod diameter of the alloy is at least 5 mm; and where the notch toughness of the metallic glass formed from the alloy is at least 96 MPa $m^{1/2}$.

In another embodiment, $-1 \le w < 0.5$.

In another embodiment, $-0.5 \le w < 0.5$.

In another embodiment, $-0.4 \le x \le 0.8$.

In another embodiment, $-0.3 \times 0.6$.

In another embodiment, $-2.7 \le z \le 3.8$.

In another embodiment, $-2.8 \le z \le 3.8$.

In another embodiment, $20.2+0.2w-0.65|x|-z \le y \le 20.7-z$.

In another embodiment, $20.2+0.2w-0.65|x|-z \le y \le 20.6-z$.

In another embodiment, $0 \le a \le 0.8$.

In another embodiment, $0 \le a \le 0.6$.

In another embodiment, up to 2 atomic percent of Ni is substituted by Co, Fe, Cu, Ru, Re, Pd, Pt, or a combination thereof.

In another embodiment, up to 1 atomic percent of Cr is substituted by Mn, W, Mo, or a combination thereof.

In another embodiment, up to 1.5 atomic percent of Nb is substituted by Ta, V, or a combination thereof.

In another embodiment, the disclosure is directed to an alloy capable of forming a metallic glass comprising:

Cr in an atomic percent of 2 with a variance w of from −1.5 to less than 0.5;

Nb in an atomic percent of 3 with a variance x of from −0.5 to 1;

B in an atomic percent z ranging from 2.6 to 4;

P and optionally Si, where the combined P and Si atomic percent ranges from $20.2+0.2w-0.65|x|-z$ to $20.8-z$, where the atomic fraction of Si in the combined P and Si atomic percent ranges from 0 to 0.1;

where the balance is Ni and incidental impurities;

where the critical rod diameter of the alloy is at least 5 mm; and where the notch toughness of the metallic glass formed from the alloy is at least 96 MPa $m^{1/2}$.

In some aspects, an alloy can include a small amount of incidental impurities. The impurity elements can be present, for example, as a byproduct of processing and manufacturing. The impurities can be less than or equal to about 2 wt %, alternatively less than or equal about 1 wt %, alternatively less than or equal about 0.5 wt %, alternatively less than or equal about 0.1 wt %.

In another embodiment, the alloy additionally comprises Co in an atomic fraction of up to 20%.

In another embodiment, up to 20 atomic percent of Ni is substituted by Co.

In another embodiment, the alloy additionally comprises Co, Fe, Cu, or combinations thereof, in an atomic fraction of up to 10%.

In another embodiment, up to 10 atomic percent of Ni is substituted by Co, Fe, Cu, or combinations thereof.

In another embodiment, the alloy additionally comprises Co, Fe, Mn, W, Mo, Ru, Re, Cu, Pd, Pt, Ta, V, or combinations thereof, in an atomic fraction of up to 2%.

In another embodiment, up to 2 atomic percent of Ni is substituted by Co, Fe, Cu, Ru, Re, Cu, Pd, Pt, or combinations thereof.

In another embodiment, up to 1 atomic percent of Cr is substituted by Mn, W, Mo, or combinations thereof.

In another embodiment, up to 1.5 atomic percent of Nb is substituted by Ta, V, or combinations thereof.

In another embodiment, the critical rod diameter of the alloy is at least 6 mm.

In another embodiment, the critical rod diameter of the alloy is at least 7 mm.

In another embodiment, the critical rod diameter of the alloy is at least 8 mm.

In another embodiment, the notch toughness of the metallic glass formed from the alloy is at least 96 MPa $m^{1/2}$.

In another embodiment, the notch toughness of the metallic glass formed from the alloy is at least 97 MPa $m^{1/2}$.

In another embodiment, the notch toughness of the metallic glass formed from the alloy is at least 98 MPa $m^{1/2}$.

In another embodiment, the notch toughness of the metallic glass formed from the alloy is at least 99 MPa $m^{1/2}$.

In another embodiment, the notch toughness of the metallic glass formed from the alloy is at least 100 MPa $m^{1/2}$.

In another embodiment, the atomic concentration of Nb is less than 3.6 percent, and the notch toughness of the metallic glass formed from the alloy is at least 100 MPa $m^{1/2}$.

In another embodiment, the atomic concentration of B is less than 3.8 percent, and the notch toughness of the metallic glass formed from the alloy is at least 100 MPa $m^{1/2}$.

In another embodiment, the atomic concentration of metalloids is in the range of 20 to 20.7 percent, and the notch toughness of the metallic glass formed from the alloy is at least 100 MPa $m^{1/2}$.

In another embodiment, the atomic concentration of Cr is not more than 2 percent, and the notch toughness of the metallic glass formed from the alloy is at least 100 MPa $m^{1/2}$.

The disclosure is also directed to an alloy capable of forming a metallic glass having compositions selected from a group consisting of $Ni_{74.8}Cr_2Nb_{2.9}P_{16.75}Si_{0.26}B_{3.3}$, $Ni_{74.8}Cr_2Nb_{2.9}P_{16.5}Si_{0.5}B_{3.3}$, $Ni_{74.8}Cr_2Nb_{2.9}P_{16.25}Si_{0.75}B_{3.3}$, $Ni_{75}Cr_2Nb_{2.7}P_{16.5}Si_{0.5}B_{3.3}$, $Ni_{74.6}Cr_2Nb_{3.1}P_{16.5}Si_{0.5}B_{3.3}$, $Ni_{74.4}Cr_2Nb_{3.3}P_{16.5}Si_{0.5}B_{3.3}$, $Ni_{74.2}Cr_2Nb_{3.5}P_{16.5}Si_{0.5}B_{3.3}$, $Ni_{74}Cr_2Nb_{3.7}P_{16.5}Si_{0.5}B_{3.3}$, $Ni_{73.8}Cr_2Nb_{3.9}P_{16.5}Si_{0.5}B_{3.3}$, $Ni_{74.4}Cr_2Nb_{3.3}P_{17.1}Si_{0.5}B_{2.7}$, $Ni_{74.4}Cr_2Nb_{3.3}P_{16.9}Si_{0.5}B_{2.9}$, $Ni_{74.4}Cr_2Nb_{3.3}P_{16.7}Si_{0.5}B_{3.1}$, $Ni_{74.4}Cr_2Nb_{3.3}P_{16.3}Si_{0.5}B_{3.5}$, $Ni_{74.4}Cr_2Nb_{3.3}P_{16.1}Si_{0.5}B_{3.7}$, $Ni_{74.4}Cr_2Nb_{3.3}P_{15.9}Si_{0.5}B_{3.9}$, $Ni_{74.21}Cr_2Nb_{3.29}P_{16.66}Si_{0.51}B_{3.33}$, $Ni_{74.03}Cr_{1.99}Nb_{3.28}P_{16.83}Si_{0.51}B_{3.36}$ $Ni_{75.4}Cr_1Nb_{3.3}P_{16.5}Si_{0.5}B_{3.3}$, $Ni_{74.9}Cr_{1.5}Nb_{3.3}P_{16.5}Si_{0.5}B_{3.3}$, and $Ni_{74.4}Cr_2Nb_{3.3}P_{16.5}Si_{0.5}B_{3.3}$.

The disclosure is further directed to a metallic glass having any of the above formulas and/or formed of any of the foregoing alloys.

In a further embodiment, a method is provided for forming an article of a metallic glass comprising an alloy according to the present disclosure. The method includes melting the alloy to form a molten alloy and subsequently quenching the molten alloy at a cooling rate sufficiently high to prevent crystallization of the alloy.

In yet another embodiment, the molten alloy is fluxed with a reducing agent prior to the quenching.

In yet another embodiment, the molten alloy is fluxed with boron oxide prior to the quenching.

In yet another embodiment, the temperature of the molten alloy prior to quenching is at least 100° C. above the liquidus temperature of the alloy.

In yet another embodiment, the temperature of the molten alloy prior to quenching is at least 1100° C.

Additional embodiments and features are set forth in part in the description that follows, and in part will become apparent to those skilled in the art upon examination of the specification or may be learned by the practice of the disclosed subject matter. A further understanding of the nature and advantages of the disclosure may be realized by reference to the remaining portions of the specification and the drawings, which forms a part of this disclosure.

BRIEF DESCRIPTION OF THE DRAWINGS

The description will be more fully understood with reference to the following figures and data graphs, which are presented as various embodiments of the disclosure and should not be construed as a complete recitation of the scope of the disclosure, wherein.

DETAILED DESCRIPTION

Figure 1:
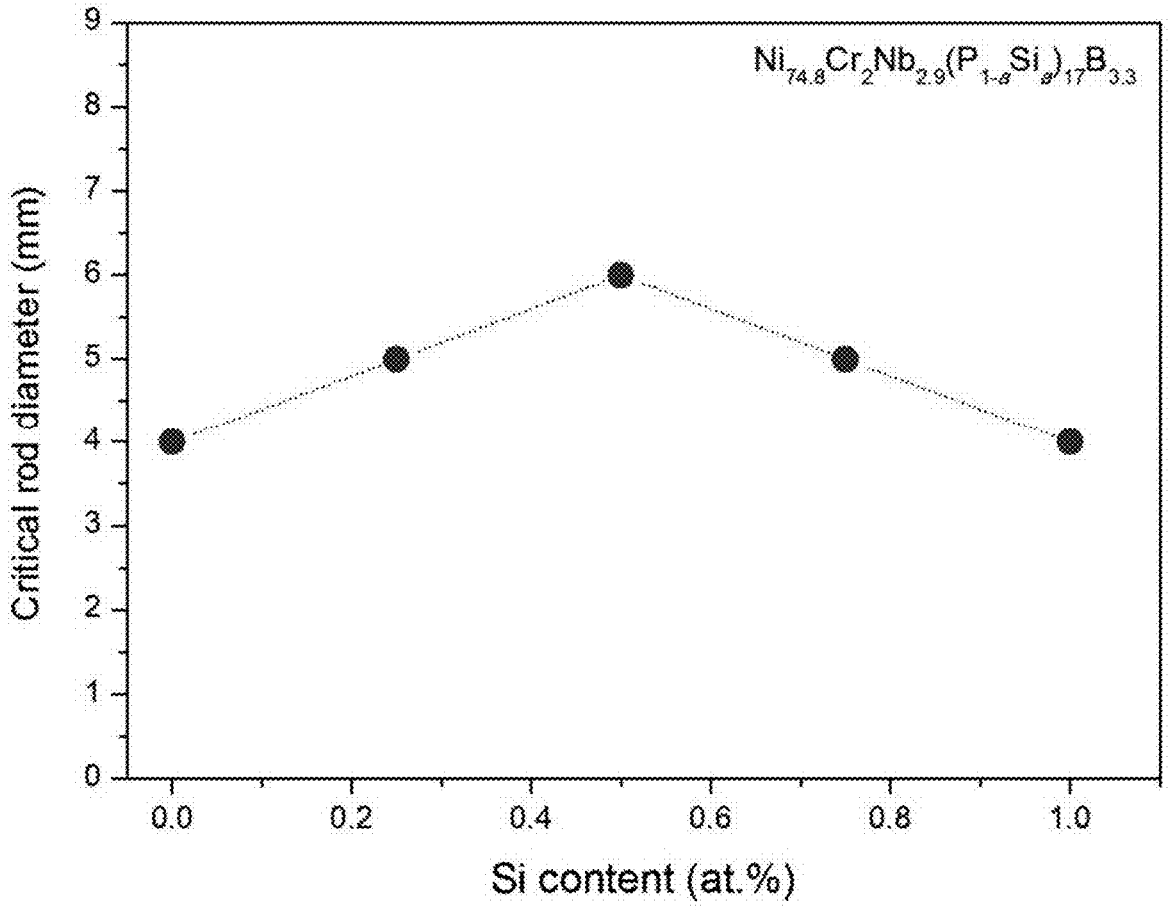
FIG. 1 provides a data plot showing the effect of varying the Si atomic concentration at the expense of P according to the formula $Ni_{74.8}Cr_2Nb_{2.9}(P_{1-a}Si_a)_{17}B_{3.3}$ on the critical rod diameter of the alloys in accordance with embodiments of the disclosure.

The disclosure is directed to alloys, metallic glasses, and methods of making and using the same. In some aspects, the alloys are described as capable of forming metallic glasses having certain characteristics. It is intended, and will be understood by those skilled in the art, that the disclosure is also directed to metallic glasses formed of the disclosed alloys described herein.

The disclosure provides a range of Ni—Cr—Nb—P—B alloys optionally bearing Si where the metallic glasses formed from the alloys demonstrate a notch toughness in excess of 95 MPa $m^{1/2}$ and the alloys have a critical rod diameter in excess of 5 mm.

Definitions

In the disclosure, the glass-forming ability of each alloy is quantified by the "critical rod diameter", defined as maximum rod diameter in which the amorphous phase can be formed when processed by a method of water quenching a quartz tube with a 0.5 mm thick wall containing the molten alloy.

A "critical cooling rate", which is defined as the cooling rate to avoid crystallization and form the amorphous phase of the alloy (i.e. a metallic glass), determines the "critical rod diameter." The lower the critical cooling rate of an alloy, the larger its critical rod diameter. The critical cooling rate $R_c$ in K/s and critical rod diameter in mm are related via the following approximate empirical formula:

$$R_c=1000/d_c^2 \quad \text{Eq. (2)}$$

For example, according to Eq. (2), the critical cooling rate for an alloy having a critical rod diameter of about 3 mm is only about $10^2$ K/s.

Generally, three categories are known in the art for identifying the ability of an alloy to form a metallic glass (i.e. to bypass the stable crystal phase and form an amorphous phase). Alloys having critical cooling rates in excess of $10^{12}$ K/s are typically referred to as non-glass formers, as it is very difficult to achieve such cooling rates and form the amorphous phase over a meaningful cross-section thickness (i.e. at least 1 micrometer). Alloys having critical cooling rates in the range of $10^5$ to $10^{12}$ K/s are typically referred to as marginal glass formers, as they are able to form glass over thicknesses ranging from 1 to 100 micrometers according to Eq. (2). Alloys having critical cooling rates on the order of $10^3$ or less, and as low as 1 or 0.1 K/s, are typically referred to as bulk glass formers, as they are able to form glass over thicknesses ranging from 1 millimeter to several centimeters. The glass-forming ability of an alloy (and by extension its critical cooling rate and critical rod diameter) is, to a very large extent, dependent on the composition of the alloy. The compositional ranges for alloys capable of forming marginal glass formers are considerably broader than those for forming bulk glass formers.

The notch toughness, defined as the stress intensity factor at crack initiation $K_q$, is the measure of the material's ability to resist fracture in the presence of a notch. The notch toughness is a measure of the work required to propagate a crack originating from a notch. A high $K_q$ ensures that the material will be tough in the presence of defects.

The width of the supercooled region $\Delta T_x$ is defined as the difference between the crystallization temperature $T_x$ and the glass transition temperature $T_g$ of the metallic glass, $\Delta T_x = T_x - T_g$, measured at heating rate of 20 K/min. A large $\Delta T_x$ value implies a large thermal stability of the supercooled liquid and designates an ability of the metallic glass to be formed into an article by thermoplastic processing at temperatures above $T_g$.

Description of Alloy and Metallic Glass Compositions

In accordance with the provided disclosure and drawings, Ni—Cr—Nb—P—B alloys optionally bearing Si and metallic glasses formed from these alloys are provided within a well-defined compositional range requiring very low cooling rates to form metallic glasses, thereby allowing for bulk metallic glass formation such that metallic glass rods with critical rod diameters of at least 5 mm can be formed, and where the metallic glasses formed from the disclosed alloys demonstrate a notch toughness greater than 95 MPa $m^{1/2}$.

Ni—Cr—Nb—P—B alloys optionally bearing Si that fall within the compositional ranges of the disclosure having a critical rod diameter of at least 5 mm forming metallic glasses that demonstrate notch toughness of at least 96 MPa $m^{1/2}$ can be represented by the following formula (subscripts w, x, y, and z denote deviations from a nominal concentration in atomic percentages, while a denotes an atomic fraction):

$$Ni_{(95-w-x-y-z)}Cr_{2+w}Nb_{3+x}(P_{1-a}Si_a)_yB_z \quad \text{Eq. (1)}$$

$-1.5 \le w < 0.5$;

$-0.5 \le x \le 1$;

$2.6 \le z \le 4$;

$20.2 + 0.2w - 0.65|x| - z \le y \le 20.8 - z$;

$0 \le a \le 0.1$;

where the critical rod diameter of the alloys is at least 5 mm; and where the notch toughness of the metallic glasses formed from the alloys is at least 96 MPa $m^{1/2}$.

Specific embodiments of metallic glasses formed of alloys having compositions according to the formula $Ni_{74.8}Cr_2Nb_{2.9}(P_{1-a}Si_a)_{17}B_{3.3}$, where a ranges from 0 to 1/17, are presented in Table 1. Note that parameter c in formula $Ni_{74.8}Cr_2Nb_{2.9}(P_{1-a}Si_a)_{17}B_{3.3}$ is equivalent to parameter a in Eq. (1). The corresponding critical rod diameters and notch toughness values are also listed in Table 1.

FIG. 1 provides a data plot showing the effect of varying the Si atomic concentration at the expense of P according to the formula $Ni_{74.8}Cr_2Nb_{2.9}(P_{1-a}Si_a)_{17}B_{3.3}$ on the critical rod diameter of the alloys. The critical rod diameter is shown to increase slightly from 4 mm to a peak value of 6 mm as the Si concentration increases from 0 to 0.5 atomic percent, and then decreases to 4 mm as the Si concentration increases further to 1 atomic percent. The critical rod diameter is at least 5 mm when Si concentration ranges from 0.25 to 0.75 atomic percent.

Figure 2:
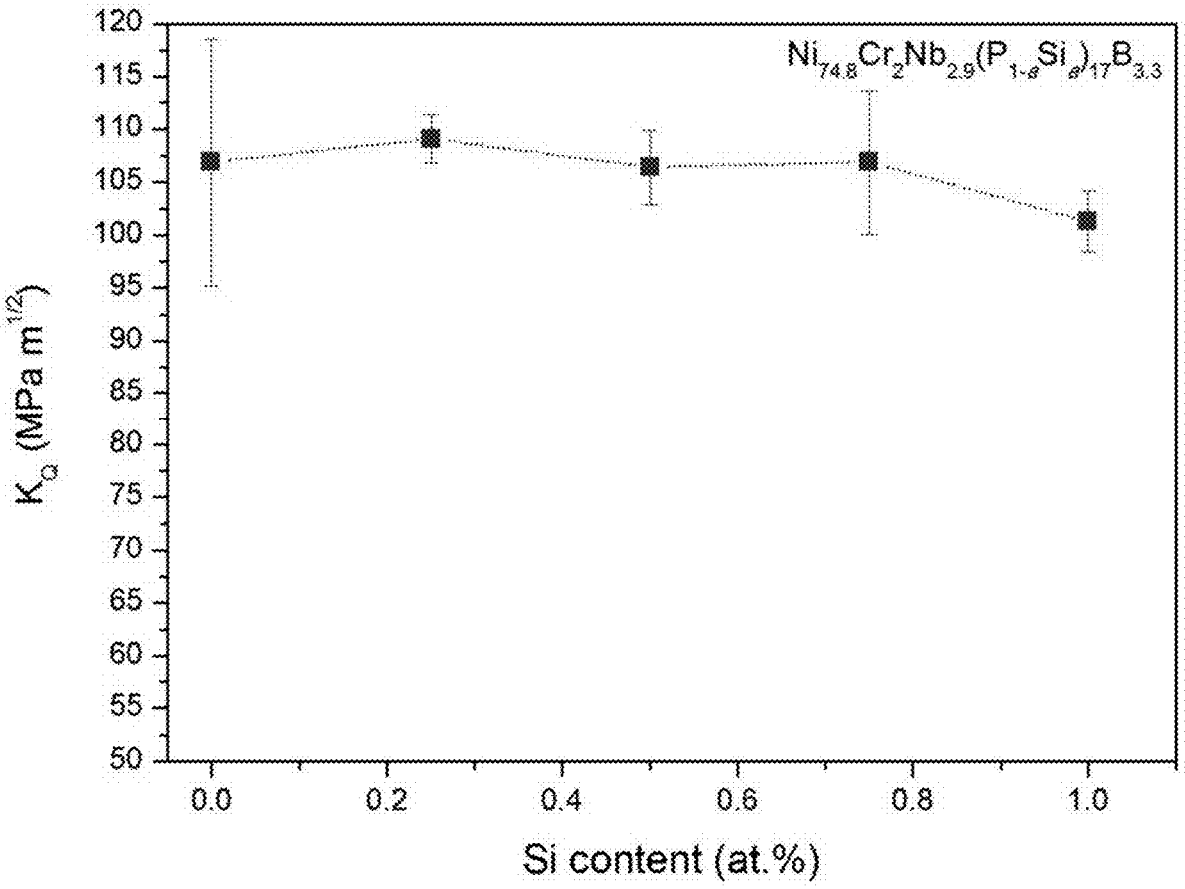
FIG. 2 provides a data plot showing the effect of varying the Si atomic concentration at the expense of P according to the formula $Ni_{74.8}Cr_2Nb_{2.9}(P_{1-a}Si_a)_{17}B_{3.3}$ on the notch toughness of the metallic glasses in accordance with embodiments of the disclosure.

FIG. 2 provides a data plot showing the effect of varying the Si atomic concentration at the expense of P according to the formula $Ni_{74.8}Cr_2Nb_{2.9}(P_{1-a}Si_a)_{17}B_{3.3}$ on the notch toughness of the metallic glasses. The notch toughness is shown to be greater than 100 MPa $m^{1/2}$ when the Si concentration is in the range of 0 to 1 atomic percent, and greater than 105 MPa $m^{1/2}$ when the Si concentration is in the range of 0 to 0.75 atomic percent.

TABLE 1

Sample alloys demonstrating the effect of increasing the Si atomic concentration at the expense of P according to the formula $Ni_{74.8}Cr_2Nb_{2.9}(P_{1-a}Si_a)_{17}B_{3.3}$ on the critical rod diameter and notch toughness of the sample metallic glass formed of the sample alloys.

| Sample | Composition | Critical Rod Diameter [mm] | Notch Toughness $K_Q$ (MPa $m^{1/2}$) |
|---|---|---|---|
| 1 | $Ni_{74.8}Cr_2Nb_{2.9}P_{17}B_{3.3}$ | 4 | 106.9 ± 11.7 |
| 2 | $Ni_{74.8}Cr_2Nb_{2.9}P_{16.75}Si_{0.25}B_{3.3}$ | 5 | 109.1 ± 2.3 |
| 3 | $Ni_{74.8}Cr_2Nb_{2.9}P_{16.5}Si_{0.5}B_{3.3}$ | 6 | 106.4 ± 3.5 |
| 4 | $Ni_{74.8}Cr_2Nb_{2.9}P_{16.25}Si_{0.75}B_{3.3}$ | 5 | 106.9 ± 6.8 |
| 5 | $Ni_{74.8}Cr_2Nb_{2.9}P_{16}Si_1B_{3.3}$ | 4 | 101.3 ± 2.9 |

Figure 3:
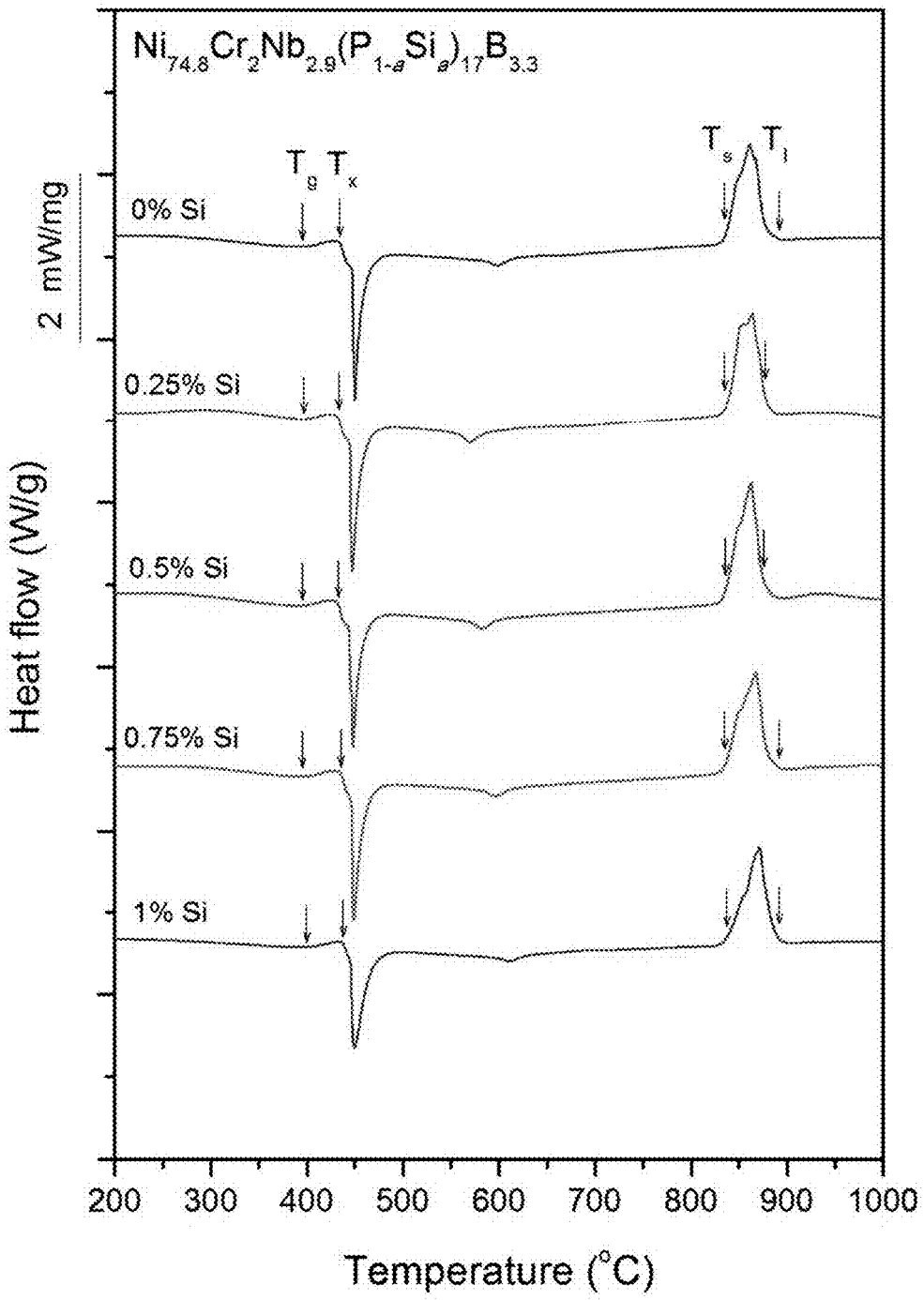
FIG. 3 provides calorimetry scans for sample metallic glasses $Ni_{74.8}Cr_2Nb_{2.9}(P_{1-a}Si_a)_{17}B_{3.3}$ in accordance with embodiments of the disclosure. The glass transition temperature $T_g$, crystallization temperature $T_x$, solidus temperature $T_s$, and liquidus temperature $T_l$ are indicated by arrows.

FIG. 3 provides calorimetry scans for sample metallic glasses $Ni_{74.8}Cr_2Nb_{2.9}(P_{1-a}Si_a)_{17}B_{3.3}$ in accordance with embodiments of the disclosure. The glass transition temperature $T_g$, crystallization temperature $T_x$, solidus temperature $T_s$, and liquidus temperature $T_l$ are indicated by arrows in FIG. 3. Table 2 lists the glass transition temperature $T_g$, crystallization temperature $T_x$, solidus temperature $T_s$, and liquidus temperature $T_l$ along with the respective $\Delta T_x$ value for sample metallic glasses $Ni_{74.8}Cr_2Nb_{2.9}(P_{1-a}Si_a)_{17}B_{3.3}$ in accordance with embodiments of the disclosure.

As shown in Table 2, the value for the metallic glass containing 0 atomic percent Si (Sample 1) is 38.9° C., while the value for the metallic glass containing 0.25 atomic percent Si (Sample 2) is 35.8° C. and the value for the metallic glass containing 0.5 atomic percent Si (Sample 2) is 37.3° C., which are smaller than the Si-free metallic glass (Sample 1). However, the value for the metallic glass containing 0.75 atomic percent Si (Sample 4) is 39.2° C., which is close to the Si-free metallic glass. The value for the metallic glass containing 1 atomic percent Si (Sample 5) drops to 37.1° C. For sample metallic glasses where the Si concentration is up to 1, $\Delta T_x$ is at least 35° C.

TABLE 2

Sample alloys demonstrating the effect of increasing the Si atomic concentration at the expense of P according to the formula $Ni_{74.8}Cr_2Nb_{2.9}(P_{1-a}Si_a)_{17}B_{3.3}$ on the glass transition temperature $T_g$, crystallization temperature $T_x$, solidus temperature $T_s$, liquidus temperature $T_l$ and on $\Delta T_x$ (=$T_x$ − $T_g$).

| Sample | Composition | $T_g$ (° C.) | $T_x$ (° C.) | $\Delta T_x$ (° C.) | $T_s$ (° C.) | $T_l$ (° C.) |
|---|---|---|---|---|---|---|
| 1 | $Ni_{74.8}Cr_2Nb_{2.9}P_{17}B_{3.3}$ | 395.8 | 434.7 | 38.9 | 835.5 | 892.4 |
| 2 | $Ni_{74.8}Cr_2Nb_{2.9}P_{16.75}Si_{0.25}B_{3.3}$ | 396.7 | 432.5 | 35.8 | 835.0 | 877.9 |
| 3 | $Ni_{74.8}Cr_2Nb_{2.9}P_{16.5}Si_{0.5}B_{3.3}$ | 394.9 | 432.2 | 37.3 | 834.9 | 875.3 |
| 4 | $Ni_{74.8}Cr_2Nb_{2.9}P_{16.25}Si_{0.75}B_{3.3}$ | 396.0 | 435.2 | 39.2 | 835.2 | 892.7 |
| 5 | $Ni_{74.8}Cr_2Nb_{2.9}P_{16}Si_1B_{3.3}$ | 400.4 | 437.5 | 37.1 | 836.6 | 892.2 |

Specific embodiments of metallic glasses formed of alloys having compositions according to the formula $Ni_{74.7-x}Cr_2Nb_{3+x}P_{16.5}Si_{0.5}B_{3.3}$, where x ranges from −0.5 to +1.5, are presented in Table 3. The corresponding critical rod diameters and notch toughness values are also listed in Table 3.

Figure 4:
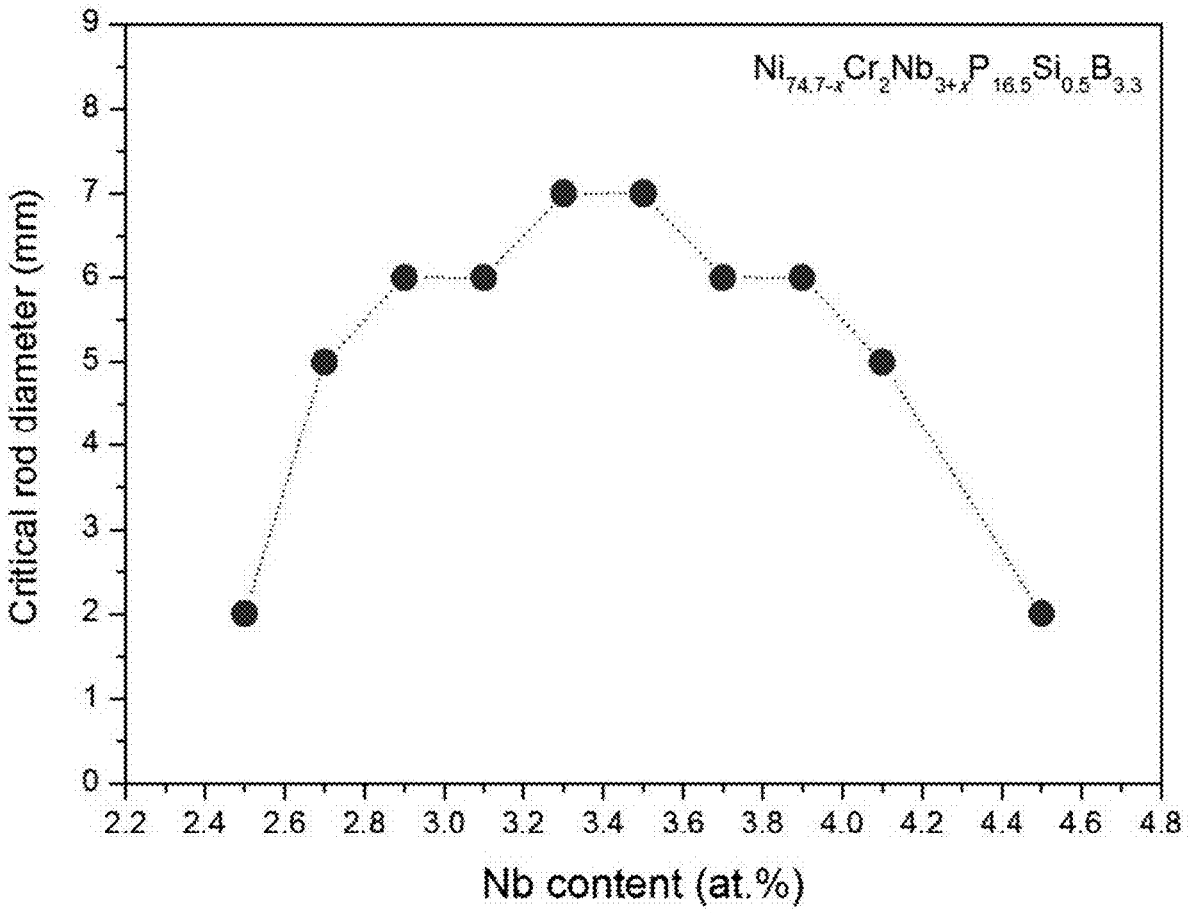
FIG. 4 provides a data plot showing the effect of varying the Nb atomic concentration at the expense of Ni according to the formula $Ni_{74.7-x}Cr_2Nb_{3+x}P_{16.5}Si_{0.5}B_{3.3}$ on the critical rod diameter of the alloys in accordance with embodiments of the disclosure.

FIG. 4 provides a data plot showing the effect of varying the Nb atomic concentration at the expense of Ni according to the formula $Ni_{74.7-x}Cr_2Nb_{3+x}P_{16.5}Si_{0.5}B_{3.3}$ on the critical rod diameter of the alloys. The critical rod diameter is shown to increase from 2 to 7 mm as the Nb concentration increases from 2.5 to about 3.2 atomic percent, and then decreases to 2 mm as the Nb concentration increases further to 4.5 atomic percent. The critical rod diameter is at least 5 mm in the range where the Nb content varies from 2.7 to 4.1 atomic percent.

Figure 5:
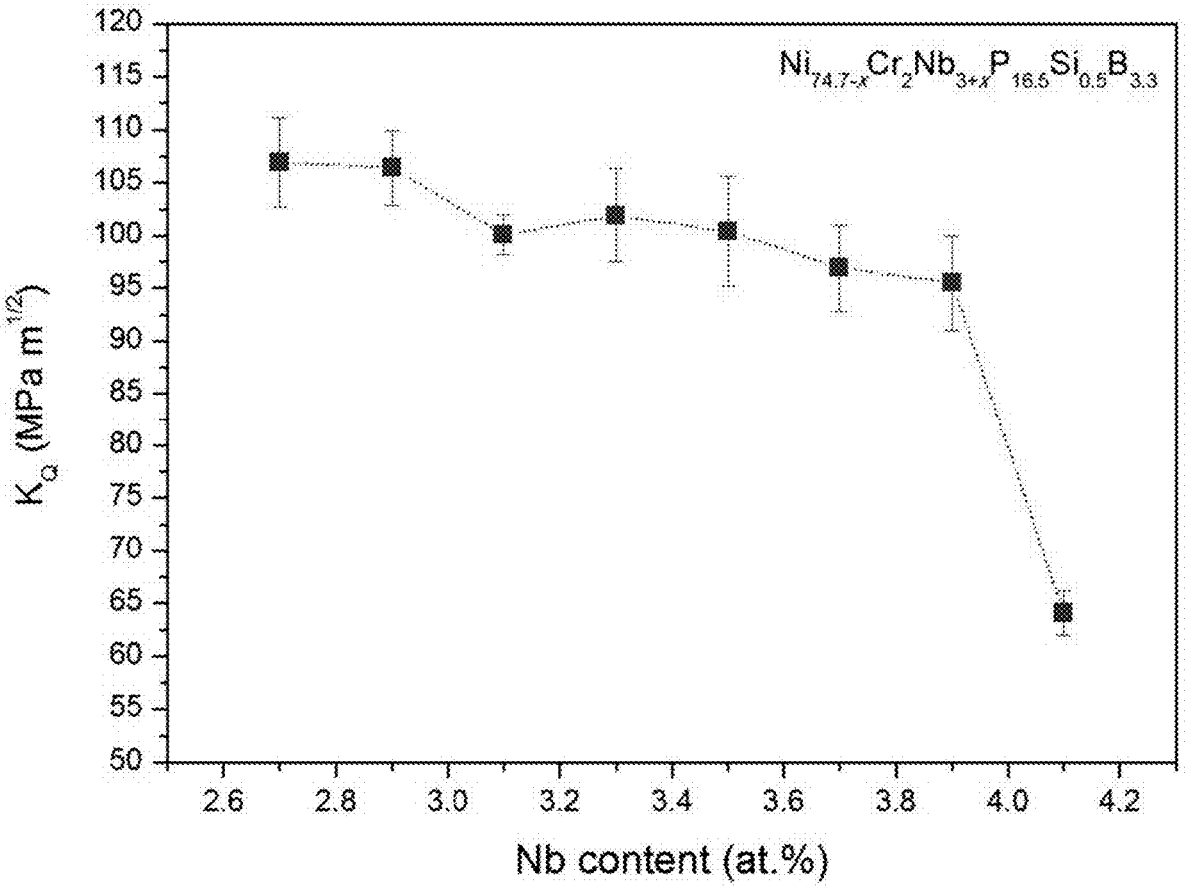
FIG. 5 provides a data plot showing the effect of varying the Nb atomic concentration at the expense of Ni according to the formula $Ni_{74.7-x}Cr_2Nb_{3+x}P_{16.5}Si_{0.5}B_{3.3}$ on the notch toughness of the metallic glasses in accordance with embodiments of the disclosure.

FIG. 5 provides a data plot showing the effect of varying the Nb atomic concentration at the expense of Ni according to the formula $Ni_{74.7-x}Cr_2Nb_{3+x}P_{16.5}Si_{0.5}B_{3.3}$ on the notch toughness of the metallic glasses. The notch toughness is shown to increase monotonically with decreasing Nb content, from 64.1 MPa $m^{1/2}$ for the alloy containing 4.1 atomic percent Nb to 106.9 MPa $m^{1/2}$ for the alloy containing 2.7 atomic percent Nb. The notch toughness is at least 96 MPa $m^{1/2}$ in the range where the Nb content is less than about 4 atomic percent, while is at least 100 MPa $m^{1/2}$ when the Nb content is less than about 3.6 atomic percent.

TABLE 3

Sample alloys demonstrating the effect of increasing the Nb atomic concentration at the expense of Ni according to the formula $Ni_{74.7-x}Cr_2Nb_{3+x}P_{16.5}Si_{0.5}B_{3.3}$ on the critical rod diameter and notch toughness of the sample metallic glass formed of the sample alloys.

| Sample | Composition | Critical Rod Diameter [mm] | Notch Toughness $K_Q$ (MPa $m^{1/2}$) |
|---|---|---|---|
| 6 | $Ni_{75.2}Cr_2Nb_{2.5}P_{16.5}Si_{0.5}B_{3.3}$ | 2 | — |
| 7 | $Ni_{75}Cr_2Nb_{2.7}P_{16.5}Si_{0.5}B_{3.3}$ | 5 | 106.9 ± 4.2 |

TABLE 3-continued

Sample alloys demonstrating the effect of increasing the Nb atomic concentration at the expense of Ni according to the formula $Ni_{74.7-x}Cr_2Nb_{3+x}P_{16.5}Si_{0.5}B_{3.3}$ on the critical rod diameter and notch toughness of the sample metallic glass formed of the sample alloys.

| Sample | Composition | Critical Rod Diameter [mm] | Notch Toughness $K_Q$ (MPa $m^{1/2}$) |
|---|---|---|---|
| 3 | $Ni_{74.8}Cr_2Nb_{2.9}P_{16.5}Si_{0.5}B_{3.3}$ | 6 | 106.4 ± 3.5 |
| 8 | $Ni_{74.6}Cr_2Nb_{3.1}P_{16.5}Si_{0.5}B_{3.3}$ | 6 | 100.1 ± 1.9 |
| 9 | $Ni_{74.4}Cr_2Nb_{3.3}P_{16.5}Si_{0.5}B_{3.3}$ | 7 | 101.9 ± 4.4 |
| 10 | $Ni_{74.2}Cr_2Nb_{3.5}P_{16.5}Si_{0.5}B_{3.3}$ | 7 | 100.4 ± 5.2 |
| 11 | $Ni_{74}Cr_2Nb_{3.7}P_{16.5}Si_{0.5}B_{3.3}$ | 6 | 96.9 ± 4.1 |
| 12 | $Ni_{73.8}Cr_2Nb_{3.9}P_{16.5}Si_{0.5}B_{3.3}$ | 6 | 95.5 ± 4.5 |
| 13 | $Ni_{73.6}Cr_2Nb_{4.1}P_{16.5}Si_{0.5}B_{3.3}$ | 5 | 64.1 ± 2.1 |
| 14 | $Ni_{73.2}Cr_2Nb_{4.5}P_{16.5}Si_{0.5}B_{3.3}$ | 2 | — |

Figure 6:
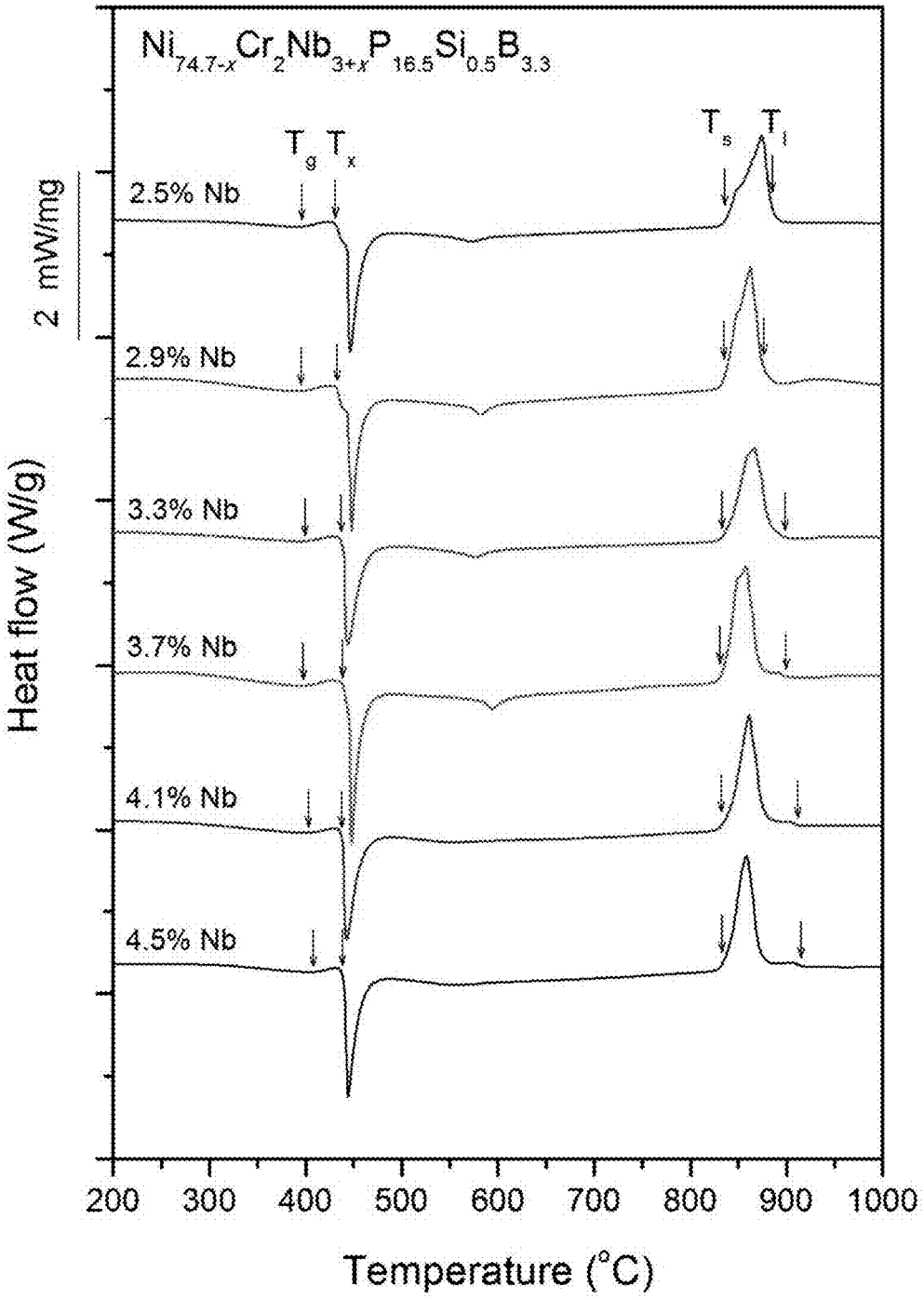
FIG. 6 provides calorimetry scans for sample metallic glasses $Ni_{74.7-x}Cr_2Nb_{3+x}P_{16.5}Si_{0.5}B_{3.3}$ in accordance with embodiments of the disclosure. The glass transition temperature $T_g$, crystallization temperature $T_x$, solidus temperature $T_s$, and liquidus temperature $T_l$ are indicated by arrows.

FIG. 6 provides calorimetry scans for sample metallic glasses $Ni_{74.7-x}Cr_2Nb_{3+x}P_{16.5}Si_{0.5}B_{3.3}$ in accordance with embodiments of the disclosure. The glass transition temperature $T_g$, crystallization temperature $T_x$, solidus temperature $T_s$, and liquidus temperature $T_l$ are indicated by arrows in FIG. 6. Table 4 lists the glass transition temperature $T_g$, crystallization temperature $T_x$, solidus temperature $T_s$, and liquidus temperature $T_l$ along with the respective $\Delta T_x$ value for sample metallic glasses $Ni_{74.7-x}Cr_2Nb_{3+x}P_{16.5}Si_{0.5}B_{3.3}$ in accordance with embodiments of the disclosure.

As shown in Table 4, the value for the metallic glass containing 3.3 atomic percent Nb (Sample 9) is 36.7° C., and the value for the metallic glass containing 3.7 atomic percent Nb (Sample 11) is 40.5° C. The value for the metallic glass containing 4.1 atomic percent Nb (Sample 13) is 34.0° C., and the value for the metallic glass containing 4.5 atomic percent Nb (Sample 14) is 30.5° C. For sample metallic glasses where the Nb concentration is equal to or less than 4 atomic percent, $\Delta T_x$ is at least 35° C.

TABLE 4

Sample alloys demonstrating the effect of increasing the Nb atomic concentration at the expense of Ni according to the formula $Ni_{74.7-x}Cr_2Nb_{3+x}P_{16.5}Si_{0.5}B_{3.3}$ on the glass transition temperature $T_g$, crystallization temperature $T_x$, solidus temperature $T_s$, liquidus temperature $T_l$ and on $\Delta T_x$ (=$T_x$ − $T_g$).

| Sample | Composition | $T_g$ (° C.) | $T_x$ (° C.) | $\Delta T_x$ (° C.) | $T_s$ (° C.) | $T_l$ (° C.) |
|---|---|---|---|---|---|---|
| 6 | $Ni_{75.2}Cr_2Nb_{2.5}P_{16.5}Si_{0.5}B_{3.3}$ | 395.5 | 430.8 | 35.3 | 835.8 | 885.3 |
| 3 | $Ni_{74.8}Cr_2Nb_{2.9}P_{16.5}Si_{0.5}B_{3.3}$ | 394.9 | 432.2 | 37.3 | 834.9 | 875.3 |
| 9 | $Ni_{74.4}Cr_2Nb_{3.3}P_{16.5}Si_{0.5}B_{3.3}$ | 399.8 | 436.5 | 36.7 | 832.5 | 898.6 |

TABLE 4-continued

Sample alloys demonstrating the effect of increasing the Nb atomic concentration at the expense of Ni according to the formula $Ni_{74.7-x}Cr_2Nb_{3+x}P_{16.5}Si_{0.5}B_{3.3}$ on the glass transition temperature $T_g$, crystallization temperature $T_x$, solidus temperature $T_s$, liquidus temperature $T_l$ and on $\Delta T_x$ (=$T_x$ − $T_g$).

| Sample | Composition | $T_g$ (° C.) | $T_x$ (° C.) | $\Delta T_x$ (° C.) | $T_s$ (° C.) | $T_l$ (° C.) |
|---|---|---|---|---|---|---|
| 11 | $Ni_{74}Cr_2Nb_{3.7}P_{16.5}Si_{0.5}B_{3.3}$ | 398.0 | 438.5 | 40.5 | 831.4 | 900.5 |
| 13 | $Ni_{73.6}Cr_2Nb_{4.1}P_{16.5}Si_{0.5}B_{3.3}$ | 402.3 | 436.3 | 34.0 | 831.9 | 911.6 |
| 14 | $Ni_{73.2}Cr_2Nb_{4.5}P_{16.5}Si_{0.5}B_{3.3}$ | 407.1 | 437.6 | 30.5 | 832.9 | 915.0 |

Specific embodiments of metallic glasses formed of alloys having compositions according to the formula $Ni_{74.4}Cr_2Nb_{3.3}P_{19.8-z}Si_{0.5}B_z$, where z ranges from 2.5 to 4.3, are presented in Table 5. The corresponding critical rod diameters and notch toughness values are also listed in Table 5.

Figure 7:
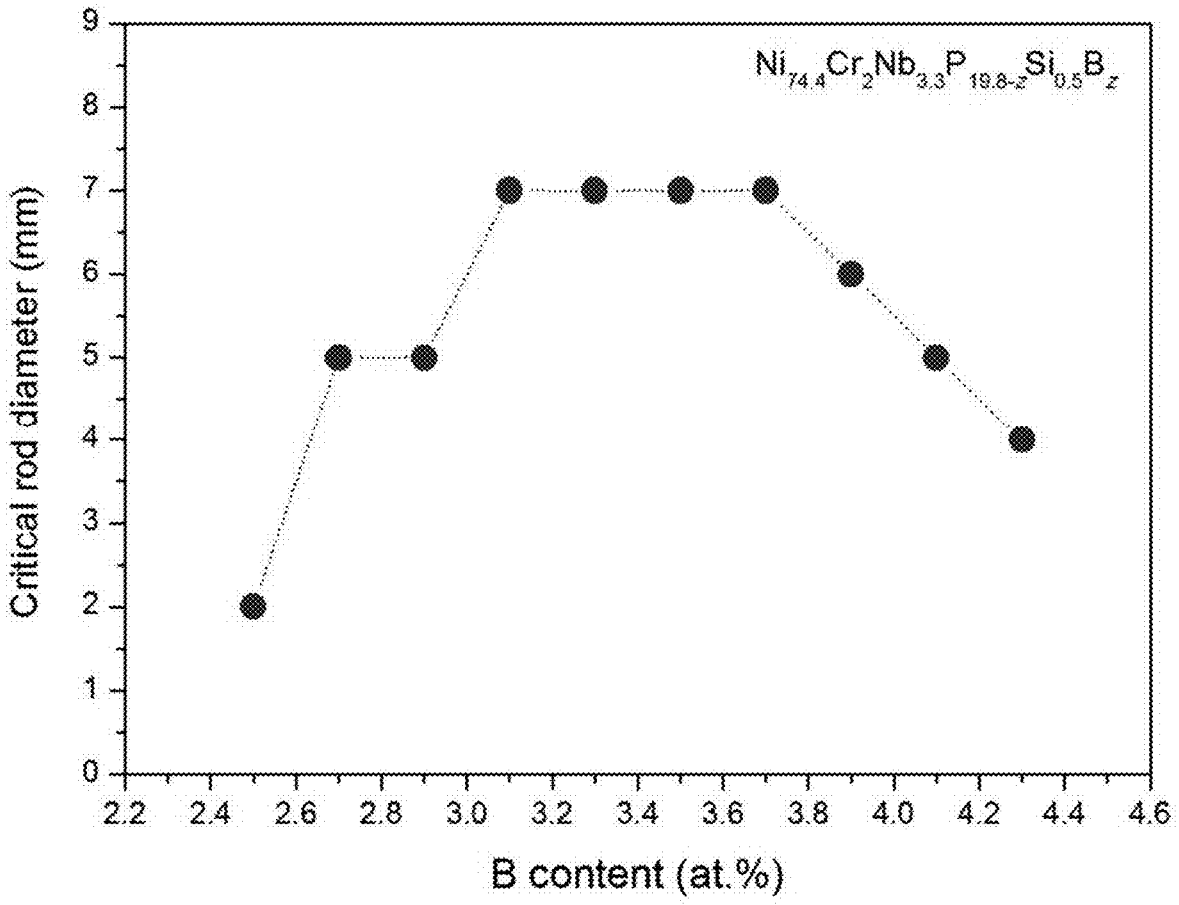
FIG. 7 provides a data plot showing the effect of varying the B atomic concentration at the expense of P according to the formula $Ni_{74.4}Cr_2Nb_{3.3}P_{19.8-z}Si_{0.5}B_z$ on the critical rod diameter of the alloys in accordance with embodiments of the disclosure.

FIG. 7 provides a data plot showing the effect of varying the B atomic concentration at the expense of P according to the formula $Ni_{74.4}Cr_2Nb_{3.3}P_{19.8-z}Si_{0.5}B_z$ on the critical rod diameter of the alloys. The critical rod diameter is shown to increase from 2 to 7 mm as the B concentration increases from 2.5 to about 3 atomic percent, remains constant at 7 mm as the B concentration is in the range of about 3 to about 3.8 atomic percent, and then decreases to 2 mm as the B concentration increases further to 4.3 atomic percent. The critical rod diameter is at least 5 mm in the range where the B content varies from about 2.6 to 4.2 atomic percent.

Figure 8:
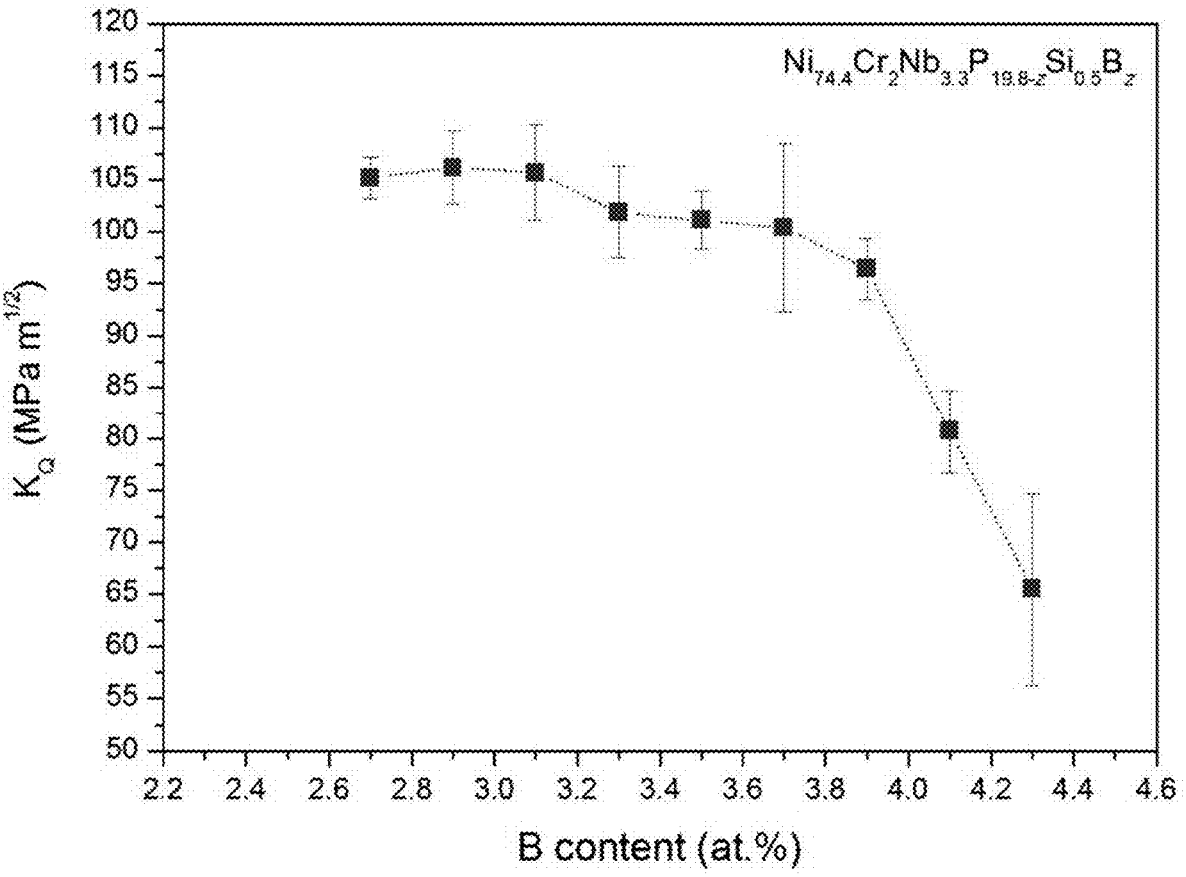
FIG. 8 provides a data plot showing the effect of varying the B atomic concentration at the expense of P according to the formula $Ni_{74.4}Cr_2Nb_{3.3}P_{19.8-z}Si_{0.5}B_z$ on the notch toughness of the metallic glasses in accordance with embodiments of the disclosure.

FIG. 8 provides a data plot showing the effect of varying the B atomic concentration at the expense of P according to the formula $Ni_{74.4}Cr_2Nb_{3.3}P_{19.8-z}Si_{0.5}B_z$ on the notch toughness of the metallic glasses. The notch toughness is shown to increase with decreasing B content, from 65.5 MPa $m^{1/2}$ for the alloy containing 4.3 atomic percent B to 106.2 MPa $m^{1/2}$ for the alloy containing 2.9 atomic percent B, and slightly drops to 105.2 MPa $m^{1/2}$ when the B content decreases further to 2.7 atomic percent. The notch toughness is at least 96 MPa $m^{1/2}$ in the range where the B content is less than about 4 atomic percent, and is at least 100 MPa $m^{1/2}$ when the B content is less than about 3.8 atomic percent.

TABLE 5

Sample alloys demonstrating the effect of increasing the B atomic concentration at the expense of P according to the formula $Ni_{74.4}Cr_2Nb_{3.3}P_{19.8-z}Si_{0.5}B_z$ on the critical rod diameter and notch toughness of the sample metallic glass formed of the sample alloys.

| Sample | Composition | Critical Rod Diameter [mm] | Notch Toughness $K_Q$ (MPa $m^{1/2}$) |
|---|---|---|---|
| 15 | $Ni_{74.4}Cr_2Nb_{3.3}P_{17.3}Si_{0.5}B_{2.5}$ | 2 | — |
| 16 | $Ni_{74.4}Cr_2Nb_{3.3}P_{17.1}Si_{0.5}B_{2.7}$ | 5 | 105.2 ± 2.0 |

TABLE 5-continued

Sample alloys demonstrating the effect of increasing the B atomic concentration at the expense of P according to the formula $Ni_{74.4}Cr_2Nb_{3.3}P_{19.8-z}Si_{0.5}B_z$ on the critical rod diameter and notch toughness of the sample metallic glass formed of the sample alloys.

| Sample | Composition | Critical Rod Diameter [mm] | Notch Toughness $K_Q$ (MPa $m^{1/2}$) |
|---|---|---|---|
| 17 | $Ni_{74.4}Cr_2Nb_{3.3}P_{16.9}Si_{0.5}B_{2.9}$ | 5 | 106.2 ± 3.5 |
| 18 | $Ni_{74.4}Cr_2Nb_{3.3}P_{16.7}Si_{0.5}B_{3.1}$ | 7 | 105.7 ± 4.6 |
| 9 | $Ni_{74.4}Cr_2Nb_{3.3}P_{16.5}Si_{0.5}B_{3.3}$ | 7 | 101.9 ± 4.4 |
| 19 | $Ni_{74.4}Cr_2Nb_{3.3}P_{16.3}Si_{0.5}B_{3.5}$ | 7 | 101.1 ± 2.8 |
| 20 | $Ni_{74.4}Cr_2Nb_{3.3}P_{16.1}Si_{0.5}B_{3.7}$ | 7 | 100.4 ± 8.1 |
| 21 | $Ni_{74.4}Cr_2Nb_{3.3}P_{15.9}Si_{0.5}B_{3.9}$ | 6 | 96.4 ± 2.9 |
| 22 | $Ni_{74.4}Cr_2Nb_{3.3}P_{15.7}Si_{0.5}B_{4.1}$ | 5 | 80.7 ± 4.0 |
| 23 | $Ni_{74.4}Cr_2Nb_{3.3}P_{15.5}Si_{0.5}B_{4.3}$ | 4 | 65.5 ± 9.2 |

Figure 9:
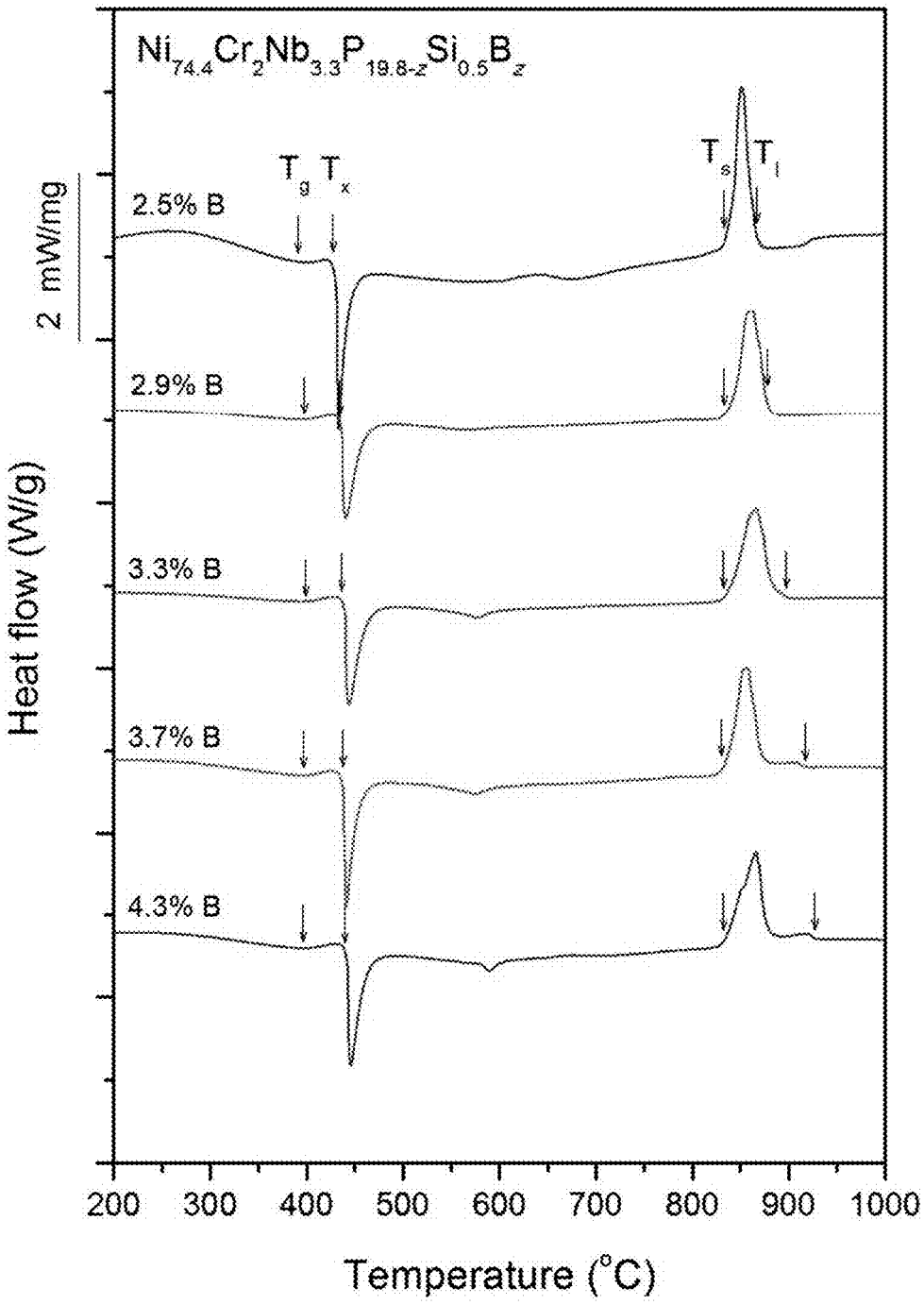
FIG. 9 provides calorimetry scans for sample metallic glasses $Ni_{74.4}Cr_2Nb_{3.3}P_{19.8-z}Si_{0.5}B_z$ in accordance with embodiments of the disclosure. The glass transition temperature $T_g$, crystallization temperature $T_x$, solidus temperature $T_s$, and liquidus temperature $T_l$ are indicated by arrows.

FIG. 9 provides calorimetry scans for sample metallic glasses $Ni_{74.4}Cr_2Nb_{3.3}P_{19.8-z}Si_{0.5}B_z$ in accordance with embodiments of the disclosure. The glass transition temperature $T_g$, crystallization temperature $T_x$, solidus temperature $T_s$, and liquidus temperature $T_l$ are indicated by arrows in FIG. 9. Table 6 lists the glass transition temperature $T_g$, crystallization temperature $T_x$, solidus temperature $T_s$, and liquidus temperature $T_l$ along with the respective $\Delta T_x$ value for sample metallic glasses $Ni_{74.4}Cr_2Nb_{3.3}P_{19.8-z}Si_{0.5}B_z$ in accordance with embodiments of the disclosure.

As shown in Table 6, $\Delta T_x$ values are larger when the B concentration exceeds 3.3 atomic percent compared to the $\Delta T_x$ values associated with lower B concentrations. Specifically, the value for the metallic glass containing 2.5 atomic percent B (Sample 15) is 35.9° C., and the value for the metallic glass containing 2.9 atomic percent B (Sample 17) is 35.9° C., and the value for the metallic glass containing 3.3 atomic percent B (Sample 9) is 36.7° C. However, the value for the metallic glass containing 3.7 atomic percent B (Sample 20) is 41.2° C., and the value for the metallic glass containing 4.3 atomic percent B (Sample 23) is 41.9° C. For sample metallic glasses where the B concentration is in the range of 2.5 to 4 atomic percent, $\Delta T_x$ is at least 35° C., while those where the B concentration is in is greater than 3.3 atomic percent, $\Delta T_x$ is at least 40° C.

TABLE 6

Sample alloys demonstrating the effect of increasing the B atomic concentration at the expense of P according to the formula $Ni_{74.4}Cr_2Nb_{3.3}P_{19.8-z}Si_{0.5}B_z$ on the glass transition temperature $T_g$, crystallization temperature $T_x$, solidus temperature $T_s$, liquidus temperature $T_l$ and on $\Delta T_x$ (=$T_x$ − $T_g$).

| Sample | Composition | $T_g$ (° C.) | $T_x$ (° C.) | $\Delta T_x$ (° C.) | $T_s$ (° C.) | $T_l$ (° C.) |
|---|---|---|---|---|---|---|
| 15 | $Ni_{74.4}Cr_2Nb_{3.3}P_{17.3}Si_{0.5}B_{2.5}$ | 391.4 | 427.5 | 35.9 | 833.1 | 866.9 |
| 17 | $Ni_{74.4}Cr_2Nb_{3.3}P_{16.9}Si_{0.5}B_{2.9}$ | 397.6 | 433.5 | 35.9 | 832.0 | 877.4 |

TABLE 6-continued

Sample alloys demonstrating the effect of increasing the B atomic concentration at the expense of P according to the formula $Ni_{74.4}Cr_2Nb_{3.3}P_{19.8-z}Si_{0.5}B_z$ on the glass transition temperature $T_g$, crystallization temperature $T_x$, solidus temperature $T_s$, liquidus temperature $T_l$ and on $\Delta T_x$ (=$T_x - T_g$).

| Sample | Composition | $T_g$ (° C.) | $T_x$ (° C.) | $\Delta T_x$ (° C.) | $T_s$ (° C.) | $T_l$ (° C.) |
|---|---|---|---|---|---|---|
| 9 | $Ni_{74.4}Cr_2Nb_{3.3}P_{16.5}Si_{0.5}B_{3.3}$ | 399.8 | 436.5 | 36.7 | 832.5 | 898.6 |
| 20 | $Ni_{74.4}Cr_2Nb_{3.3}P_{16.1}Si_{0.5}B_{3.7}$ | 396.6 | 437.8 | 41.2 | 831.0 | 917.1 |
| 23 | $Ni_{74.4}Cr_2Nb_{3.3}P_{15.5}Si_{0.5}B_{4.3}$ | 396.6 | 438.5 | 41.9 | 832.8 | 927.4 |

Specific embodiments of metallic glasses formed of alloys having compositions according to the formula $[Ni_{0.933}Cr_{0.025}Nb_{0.042}]_{100-y-z}[P_{0.813}Si_{0.025}B_{0.162}]_{y+z}$, where y+z (total metalloid concentration; i.e. the combined concentration of P, Si, and B) ranges from 19.5 to 20.9 atomic percent, are presented in Table 7. The corresponding critical rod diameters and notch toughness values are also listed in Table 7.

Figure 10:
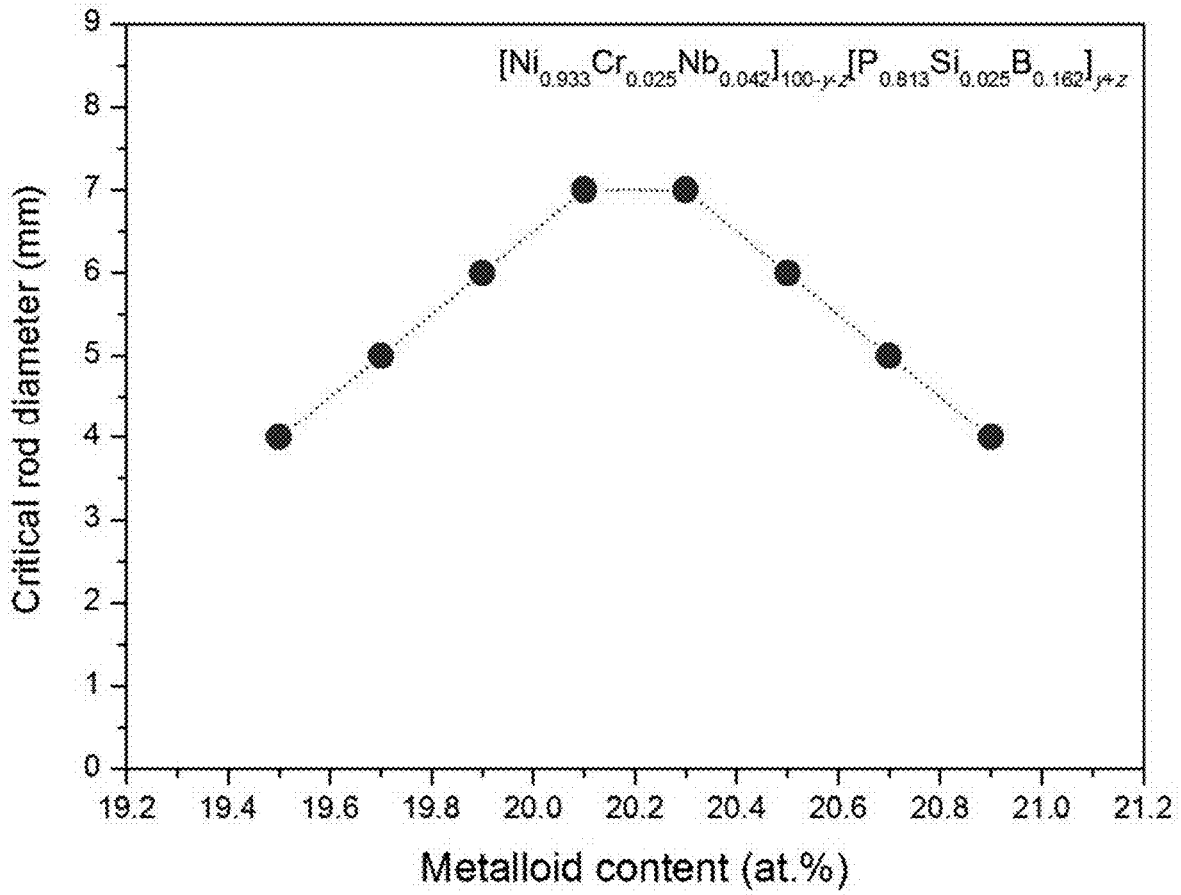
FIG. 10 provides a data plot showing the effect of varying the metalloid atomic concentration at the expense of metals according to the formula $Ni_{0.933}Cr_{0.025}Nb_{0.042}]_{100-y-z}[P_{0.813}Si_{0.025}B_{0.162}]_{y+z}$ on the critical rod diameter of the alloys in accordance with embodiments of the disclosure.

FIG. 10 provides a data plot showing the effect of varying the metalloid atomic concentration at the expense of metals according to the formula $[Ni_{0.933}Cr_{0.025}Nb_{0.042}]_{100-y-z}[P_{0.813}Si_{0.025}B_{0.162}]_{y+z}$ on the critical rod diameter of the alloys. The critical rod diameter is shown to increase from 4 to 7 mm as the metalloid concentration increases from 19.5 to about 20 atomic percent, remains constant at 7 mm as the metalloid concentration is in the range of about 20 to about 20.4 atomic percent, and then decreases to 4 mm as the metalloid concentration increases further to 20.9 atomic percent. The critical rod diameter is at least 5 mm in the range where the metalloid content varies from about 19.6 to 20.8 atomic percent.

Figure 11:
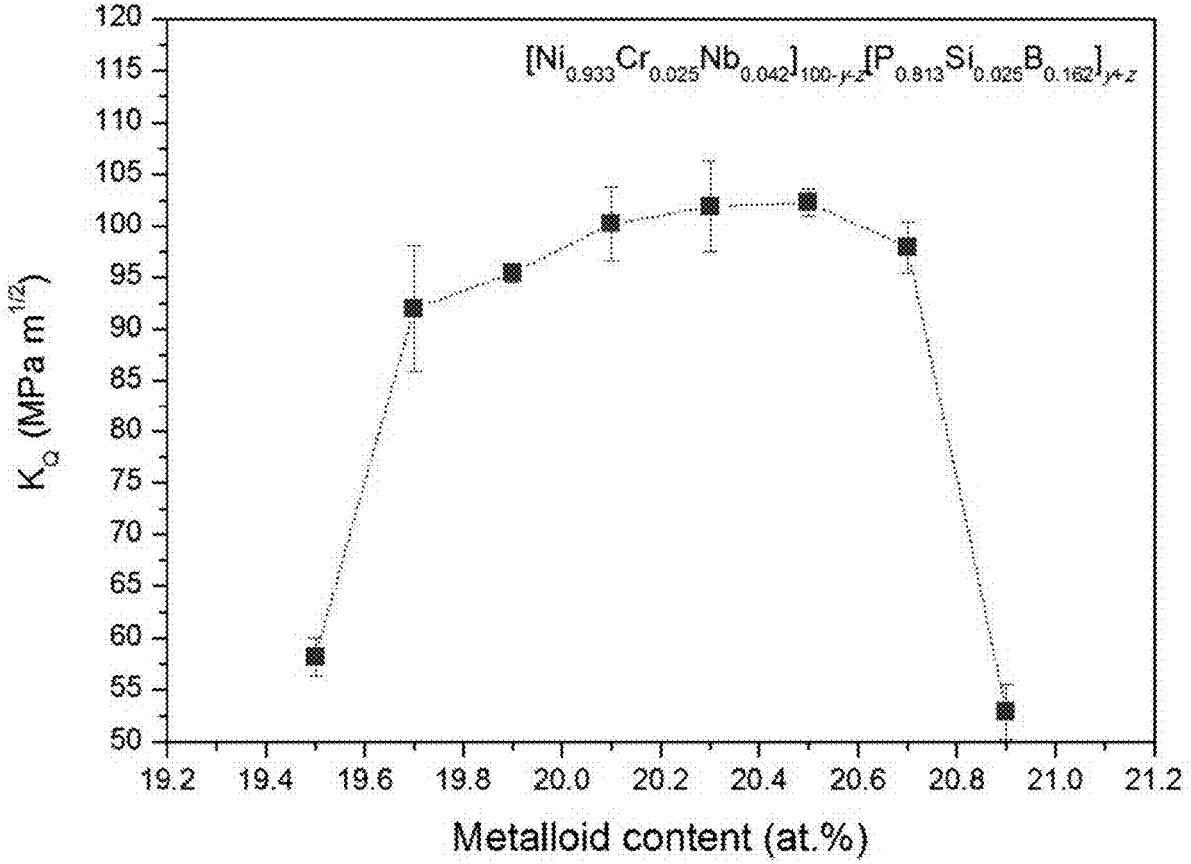
FIG. 11 provides a data plot showing the effect of varying the metalloid atomic concentration at the expense of metals according to the formula $[Ni_{0.933}Cr_{0.025}Nb_{0.042}]_{100-y-z}[P_{0.813}Si_{0.025}B_{0.162}]_{y+z}$ on the notch toughness of the metallic glasses in accordance with embodiments of the disclosure.

FIG. 11 provides a data plot showing the effect of varying the metalloid atomic concentration at the expense of metals according to the formula $[Ni_{0.933}Cr_{0.025}Nb_{0.042}]_{100-y-z}[P_{0.813}Si_{0.025}B_{0.162}]_{y+z}$ on the notch toughness of the metallic glasses. The notch toughness is shown to increase from 58.2 to 102.3 MPa $m^{1/2}$ as the metalloid content increases from 19.5 to about 20.5 atomic percent, and then unexpectedly drops to 52.9 MPa $m^{1/2}$ as the metalloid content increases further to 20.9 atomic percent. The notch toughness is at least 96 MPa $m^{1/2}$ in the range where the metalloid content varies from about 19.9 to 20.8 atomic percent, and is at least 100 MPa $m^{1/2}$ when the metalloid content is in the range of about 20 to about 20.7 atomic percent.

TABLE 7

Sample alloys demonstrating the effect of increasing the metalloid content at the expense of metals according to the formula $[Ni_{0.933}Cr_{0.025}Nb_{0.042}]_{100-y-z}[P_{0.813}Si_{0.025}B_{0.162}]_{y+z}$ on the critical rod diameter and notch toughness of the sample metallic glass formed of the sample alloys.

| Sample | Composition | Critical Rod Diameter [mm] | Notch Toughness $K_Q$ (MPa $m^{1/2}$) |
|---|---|---|---|
| 24 | $Ni_{75.15}Cr_{2.02}Nb_{3.33}P_{15.85}Si_{0.48}B_{3.17}$ | 4 | 58.2 ± 1.8 |
| 25 | $Ni_{74.96}Cr_{2.02}Nb_{3.32}P_{16.01}Si_{0.49}B_{3.2}$ | 5 | 92.0 ± 6.1 |

TABLE 7-continued

Sample alloys demonstrating the effect of increasing the metalloid content at the expense of metals according to the formula $[Ni_{0.933}Cr_{0.025}Nb_{0.042}]_{100-y-z}[P_{0.813}Si_{0.025}B_{0.162}]_{y+z}$ on the critical rod diameter and notch toughness of the sample metallic glass formed of the sample alloys.

| Sample | Composition | Critical Rod Diameter [mm] | Notch Toughness $K_Q$ (MPa $m^{1/2}$) |
|---|---|---|---|
| 26 | $Ni_{74.77}Cr_{2.01}Nb_{3.32}P_{16.17}Si_{0.49}B_{3.24}$ | 6 | 95.4 ± 0.9 |
| 27 | $Ni_{74.59}Cr_2Nb_{3.31}P_{16.34}Si_{0.49}B_{3.27}$ | 7 | 100.2 ± 3.6 |
| 9 | $Ni_{74.4}Cr_2Nb_{3.3}P_{16.5}Si_{0.5}B_{3.3}$ | 7 | 101.9 ± 4.4 |
| 28 | $Ni_{74.21}Cr_2Nb_{3.29}P_{16.66}Si_{0.51}B_{3.33}$ | 6 | 102.3 ± 1.3 |
| 29 | $Ni_{74.03}Cr_{1.99}Nb_{3.28}P_{16.83}Si_{0.51}B_{3.36}$ | 5 | 97.9 ± 2.5 |
| 30 | $Ni_{73.84}Cr_{1.98}Nb_{3.28}P_{16.99}Si_{0.51}B_{3.4}$ | 4 | 52.9 ± 2.6 |

Figure 12:
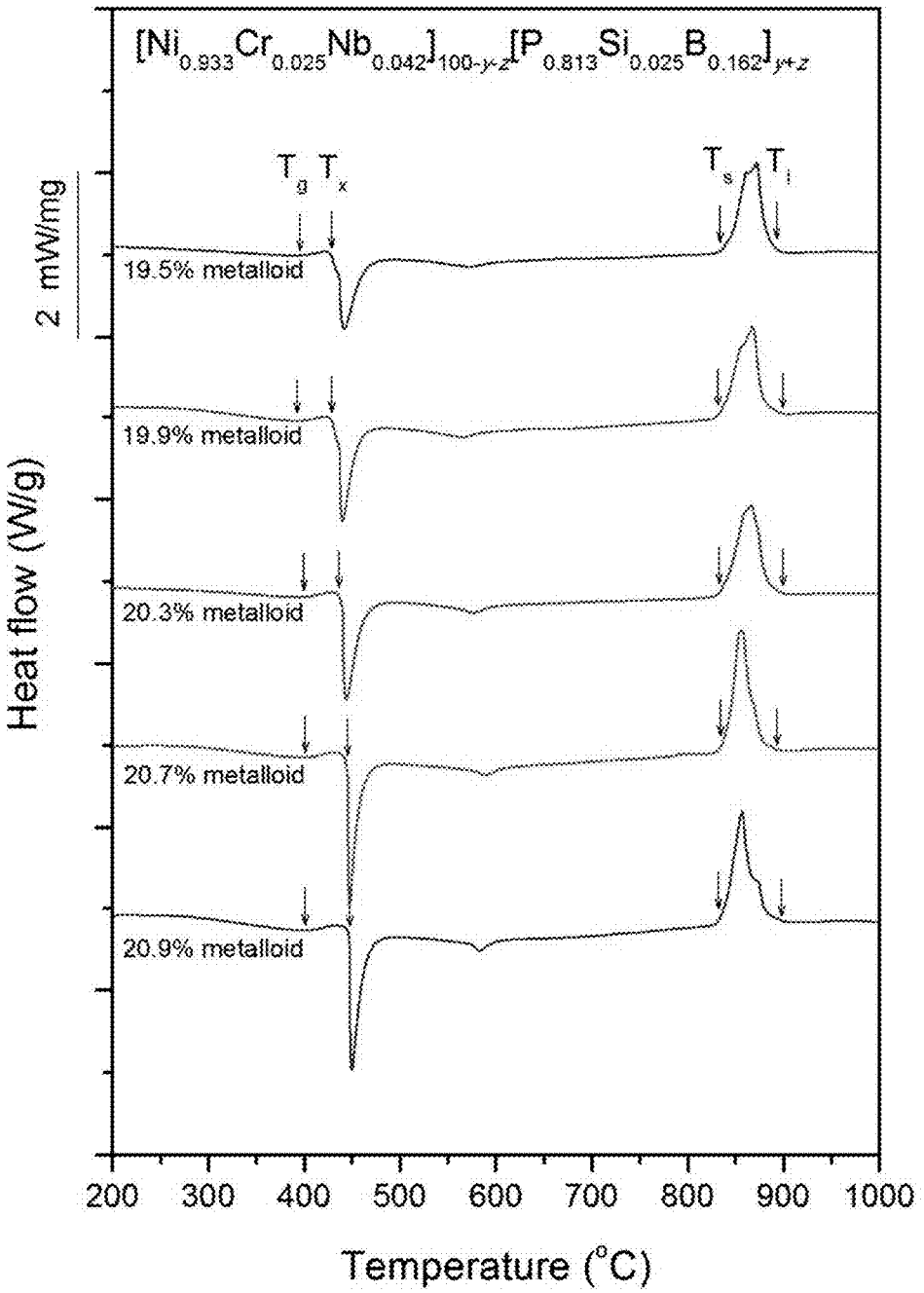
FIG. 12 provides calorimetry scans for sample metallic glasses $[Ni_{0.933}Cr_{0.025}Nb_{0.042}]_{100-y-z}[P_{0.813}Si_{0.025}B_{0.162}]_{y+z}$ in accordance with embodiments of the disclosure. The glass transition temperature $T_g$, crystallization temperature $T_x$, solidus temperature $T_s$, and liquidus temperature $T_l$ are indicated by arrows.

FIG. 12 provides calorimetry scans for sample metallic glasses $[[Ni_{0.933}Cr_{0.025}Nb_{0.0042}]_{100-y-z}[P_{0.813}Si_{0.025}B_{0.162}]_{y+z}$ in accordance with embodiments of the disclosure. The glass transition temperature $T_g$, crystallization temperature $T_x$, solidus temperature $T_s$, and liquidus temperature $T_l$ are indicated by arrows in FIG. 12. Table 8 lists the glass transition temperature $T_g$, crystallization temperature $T_x$, solidus temperature $T_s$, and liquidus temperature $T_l$ along with the respective $\Delta T_x$ value for sample metallic glasses $[Ni_{0.933}Cr_{0.025}Nb_{0.042}]_{100-y-z}[P_{0.813}Si_{0.025}B_{0.162}]_{y+z}$ in accordance with embodiments of the disclosure.

As shown in Table 8, $\Delta T_x$ values unexpectedly increase when the total metalloid concentration is in the range of greater than 20.3 to 20.9 atomic percent, as compared to the values associated with metalloid concentrations in the range of 19.5 to 20.3 atomic percent. Specifically, the $\Delta T_x$ values for the metallic glasses containing 19.5 to 20.3 atomic percent metalloids (Samples 24, 26, 9) is between 32.1° C. and 36.7° C., while the values for the metallic glasses containing 20.7 to 20.9 atomic percent metalloids (Samples 29, 30) is between 43.6° C. and 46.1° C. For sample metallic glasses where the metalloid concentration is greater than 20.5 atomic, $\Delta T_x$ is at least 40° C.

TABLE 8

Sample alloys demonstrating the effect of increasing the total metalloid concentration at the expense of metals according to the formula $[Ni_{0.933}Cr_{0.025}Nb_{0.042}]_{100-y-z}[P_{0.813}Si_{0.025}B_{0.162}]_{y+z}$ on the glass transition temperature $T_g$, crystallization temperature $T_x$, solidus temperature $T_s$, liquidus temperature $T_l$ and on $\Delta T_x$ (=$T_x$ − $T_g$).

| Sample | Composition | $T_g$ (° C.) | $T_x$ (° C.) | $\Delta T_x$ (° C.) | $T_s$ (° C.) | $T_l$ (° C.) |
|---|---|---|---|---|---|---|
| 24 | $Ni_{75.15}Cr_{2.02}Nb_{3.33}P_{15.85}Si_{0.48}B_{3.17}$ | 395.0 | 427.1 | 32.1 | 834.0 | 893.1 |
| 26 | $Ni_{74.77}Cr_{2.01}Nb_{3.32}P_{16.17}Si_{0.49}B_{3.24}$ | 392.5 | 428.6 | 36.1 | 831.9 | 899.1 |
| 9 | $Ni_{74.4}Cr_2Nb_{3.3}P_{16.5}Si_{0.5}B_{3.3}$ | 399.8 | 436.5 | 36.7 | 832.5 | 898.6 |
| 29 | $Ni_{74.03}Cr_{1.99}Nb_{3.28}P_{16.83}Si_{0.51}B_{3.36}$ | 401.5 | 445.1 | 43.6 | 834.6 | 893.5 |
| 30 | $Ni_{73.84}Cr_{1.98}Nb_{3.28}P_{16.99}Si_{0.51}B_{3.4}$ | 400.8 | 446.9 | 46.1 | 832.3 | 898.3 |

Specific embodiments of metallic glasses formed of alloys having compositions according to the formula $Ni_{74.4-w}Cr_{2+w}Nb_{3.3}P_{16.5}Si_{0.5}B_{3.3}$, where w ranges from −2 to +3, are presented in Table 9. The corresponding critical rod diameters and notch toughness values are also listed in Table 9.

Figure 13:
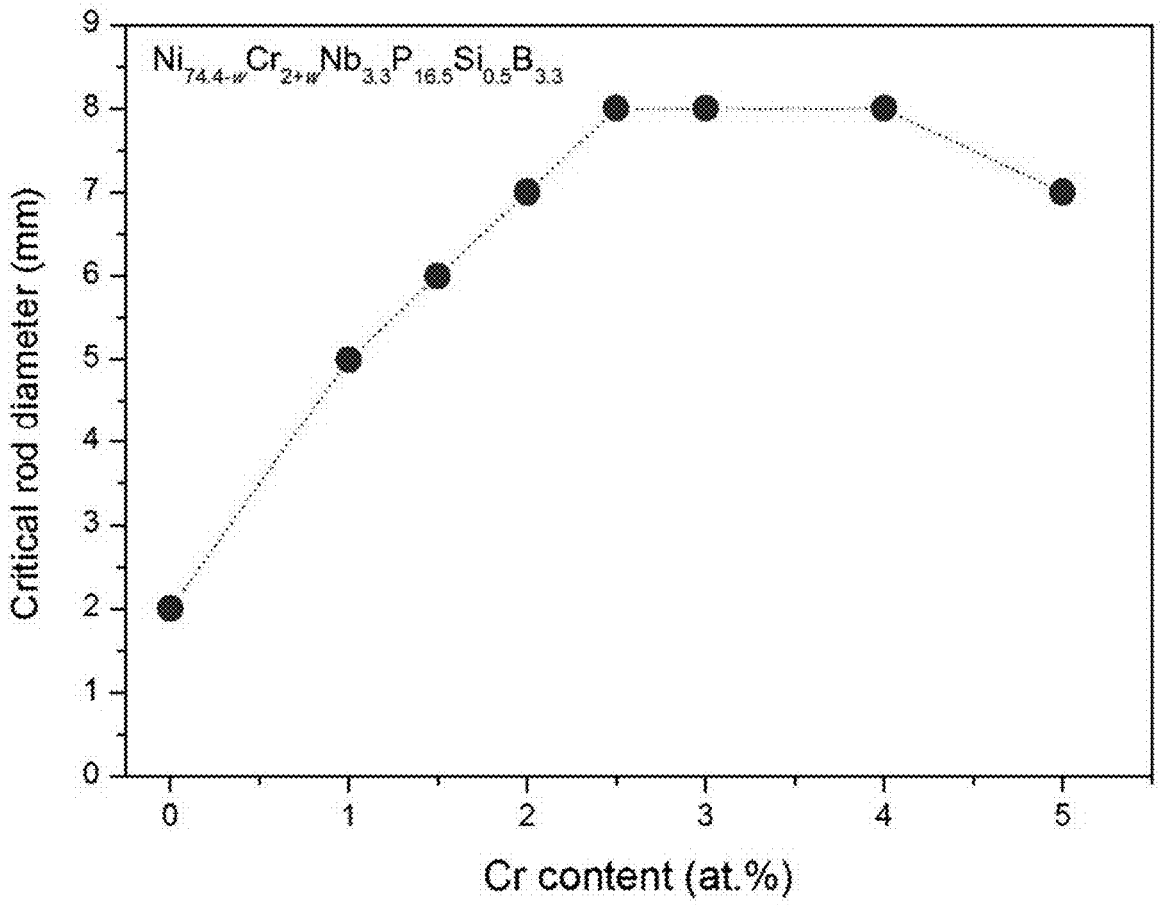
FIG. 13 provides a data plot showing the effect of varying the Cr atomic concentration at the expense of Ni according to the formula $Ni_{74.4-w}Cr_{2+w}Nb_{3.3}P_{16.5}Si_{0.5}B_{3.3}$ on the critical rod diameter of the alloys in accordance with embodiments of the disclosure.

FIG. 13 provides a data plot showing the effect of varying the Cr atomic concentration at the expense of Ni according to the formula $Ni_{74.4-w}Cr_{2+w}Nb_{3.3}P_{16.5}Si_{0.5}B_{3.3}$ on the critical rod diameter of the alloys. The critical rod diameter is shown to increase from 2 to 8 mm as the Cr concentration increases from 0 to 2.5 atomic percent, remains constant at 8 mm as the Cr concentration is in the range of 2.5 to about 4 atomic percent, and then decreases slightly back to 7 mm as the Cr concentration increases further to 5 atomic percent. The critical rod diameter is at least 5 mm when the Cr content is at least 1 atomic percent.

Figure 14:
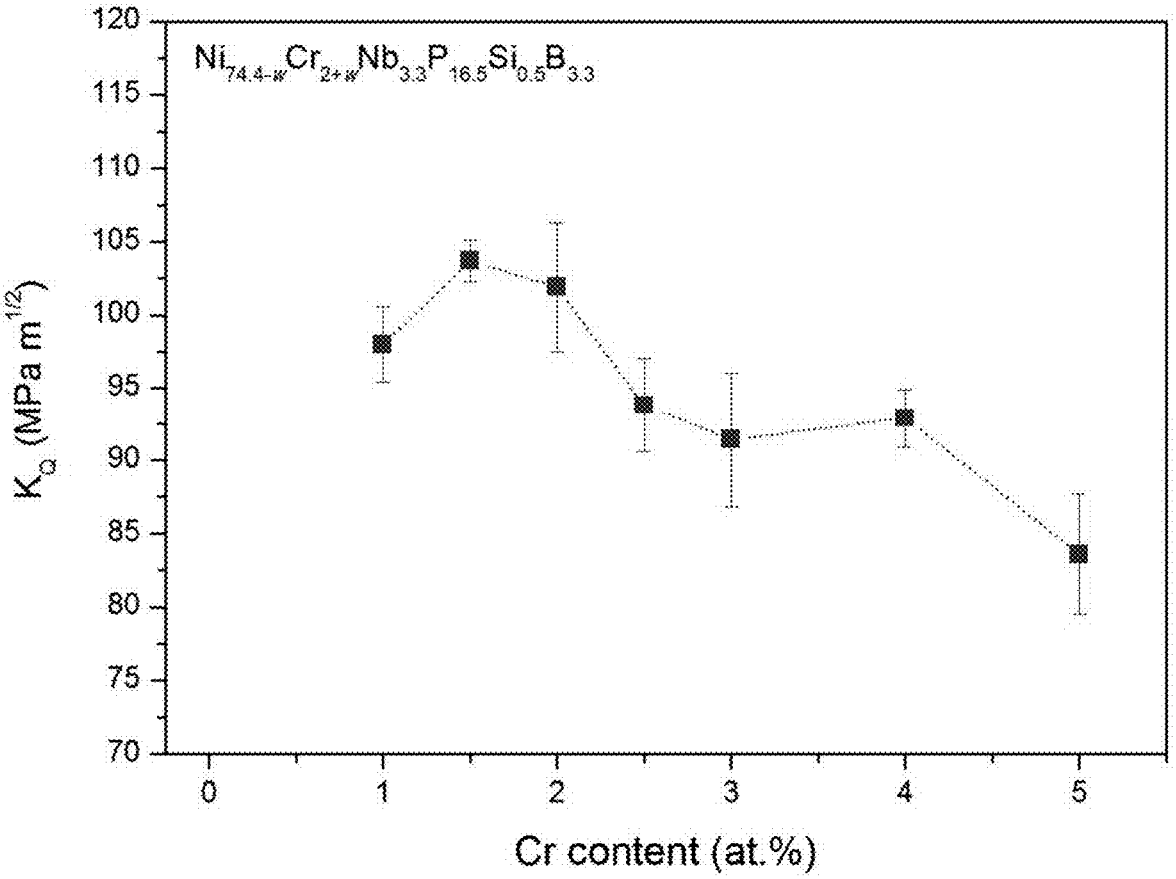
FIG. 14 provides a data plot showing the effect of varying the Cr atomic concentration at the expense of Ni according to the formula $Ni_{74.4-w}Cr_{2+w}Nb_{3.3}P_{16.5}Si_{0.5}B_{3.3}$ on the notch toughness of the metallic glasses in accordance with embodiments of the disclosure.

FIG. 14 provides a data plot showing the effect of varying the Cr atomic concentration at the expense of Ni according to the formula $Ni_{74.4-w}Cr_{2+w}Nb_{3.3}P_{16.5}Si_{0.5}B_{3.3}$ on the notch toughness of the metallic glasses. The notch toughness is shown to increase with decreasing Cr content, from 83.6 MPa $m^{1/2}$ for the alloy containing 5 atomic percent Cr to 103.7 MPa $m^{1/2}$ for the alloy containing 1.5 atomic percent Cr, and slightly drops to 98.0 MPa $m^{1/2}$ when the Cr content decreases further to 1 atomic percent. The notch toughness is at least 96 MPa $m^{1/2}$ in the range where the Cr content is less than 2.5 atomic percent, and is at least 100 MPa $m^{1/2}$ when the Cr content is not more than 2 atomic percent.

TABLE 9

Sample alloys demonstrating the effect of increasing the Cr atomic concentration at the expense of Ni according to the formula $Ni_{74.4-w}Cr_{2+w}Nb_{3.3}P_{16.5}Si_{0.5}B_{3.3}$ on the critical rod diameter and notch toughness of the sample metallic glass formed of the sample alloys.

| Sample | Composition | Critical Rod Diameter [mm] | Notch Toughness $K_Q$ (MPa $m^{1/2}$) |
|---|---|---|---|
| 31 | $Ni_{76.4}Nb_{3.3}P_{16.5}Si_{0.5}B_{3.3}$ | 2 | — |
| 32 | $Ni_{75.4}Cr_1Nb_{3.3}P_{16.5}Si_{0.5}B_{3.3}$ | 5 | 98.0 ± 2.6 |

TABLE 9-continued

Sample alloys demonstrating the effect of increasing the Cr atomic concentration at the expense of Ni according to the formula $Ni_{74.4-w}Cr_{2+w}Nb_{3.3}P_{16.5}Si_{0.5}B_{3.3}$ on the critical rod diameter and notch toughness of the sample metallic glass formed of the sample alloys.

| Sample | Composition | Critical Rod Diameter [mm] | Notch Toughness $K_Q$ (MPa $m^{1/2}$) |
|---|---|---|---|
| 33 | $Ni_{74.9}Cr_{15}Nb_{3.3}P_{16.5}Si_{0.5}B_{3.3}$ | 6 | 103.7 ± 1.4 |
| 9 | $Ni_{74.4}Cr_2Nb_{3.3}P_{16.5}Si_{0.5}B_{3.3}$ | 7 | 101.9 ± 4.4 |
| 34 | $Ni_{73.9}Cr_{2.5}Nb_{3.3}P_{16.5}Si_{0.5}B_{3.3}$ | 8 | 93.8 ± 3.2 |
| 35 | $Ni_{73.4}Cr_3Nb_{3.3}P_{16.5}Si_{0.5}B_{3.3}$ | 8 | 91.4 ± 4.6 |
| 36 | $Ni_{72.4}Cr_4Nb_{3.3}P_{16.5}Si_{0.5}B_{3.3}$ | 8 | 92.9 ± 2.0 |
| 37 | $Ni_{71.4}Cr_5Nb_{3.3}P_{16.5}Si_{0.5}B_{3.3}$ | 7 | 83.6 ± 4.1 |

Figure 15:
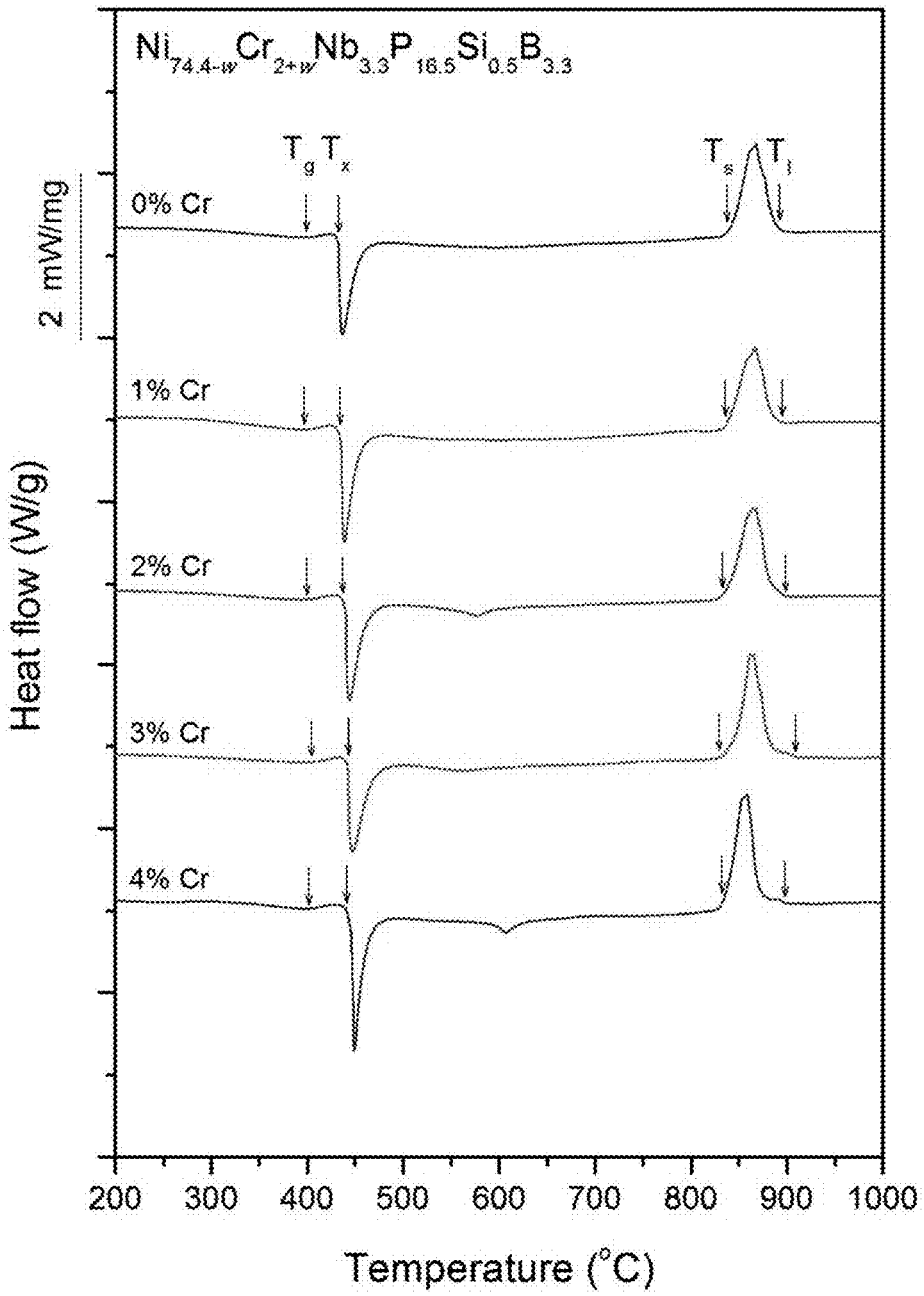
FIG. 15 provides calorimetry scans for sample metallic glasses $Ni_{74.4-w}Cr_{2+w}Nb_{3.3}P_{16.5}Si_{0.5}B_{3.3}$ in accordance with embodiments of the disclosure. The glass transition temperature $T_g$, crystallization temperature $T_x$, solidus temperature $T_s$, and liquidus temperature $T_l$ are indicated by arrows.

FIG. 15 provides calorimetry scans for sample metallic glasses $Ni_{74.4-w}Cr_2+_wNb_{3.3}P_{16.5}Si_{0.5}B_{3.3}$ in accordance with embodiments of the disclosure. The glass transition temperature $T_g$, crystallization temperature $T_x$, solidus temperature $T_s$, and liquidus temperature $T_l$ are indicated by arrows in FIG. 15. Table 10 lists the glass transition temperature $T_g$, crystallization temperature $T_x$, solidus temperature $T_s$, and liquidus temperature $T_l$ along with the respective $\Delta T_x$ value for sample metallic glasses $Ni_{74.4-w}Cr_2+_wNb_{3.3}P_{16.5}Si_{0.5}B_{3.3}$ in accordance with embodiments of the disclosure.

As shown in Table 10, the $\Delta T_x$ value for the Cr-free metallic glass is 33.2° C., the value for the metallic glass containing 1 atomic percent Cr (Sample 32) is 37.1° C., the value for the metallic glass containing 2 atomic percent Cr (Sample 9) is 36.7° C., the value for the metallic glass containing 3 atomic percent Cr (Sample 35) is 38.1° C., and the value for the metallic glass containing 4 atomic percent Cr (Sample 36) is 38.8° C. For sample metallic glasses where the atomic concentration of Cr is in the range of 0.5 to 4 atomic percent, $\Delta T_x$ is at least 35° C.

TABLE 10

Sample alloys demonstrating the effect of increasing the Cr atomic concentration at the expense of Ni according to the formula $Ni_{74.4-w}Cr_{2+w}Nb_{3.3}P_{16.5}Si_{0.5}B_{3.3}$ on the glass transition temperature $T_g$, crystallization temperature $T_x$, solidus temperature $T_s$, liquidus temperature $T_l$ and on $\Delta T_x$ (=$T_x$ − $T_g$).

| Sample | Composition | $T_g$ (° C.) | $T_x$ (° C.) | $\Delta T_x$ (° C.) | $T_s$ (° C.) | $T_l$ (° C.) |
|---|---|---|---|---|---|---|
| 31 | $Ni_{76.4}Nb_{3.3}P_{16.5}Si_{0.5}B_{3.3}$ | 399.5 | 432.7 | 33.2 | 837.6 | 892.5 |
| 32 | $Ni_{75.4}Cr_1Nb_{3.3}P_{16.5}Si_{0.5}B_{3.3}$ | 397.0 | 434.1 | 37.1 | 835.9 | 895.1 |

TABLE 10-continued

Sample alloys demonstrating the effect of increasing the Cr atomic concentration at the expense of Ni according to the formula $Ni_{74.4-w}Cr_{2+w}Nb_{3.3}P_{16.5}Si_{0.5}B_{3.3}$ on the glass transition temperature $T_g$, crystallization temperature $T_x$, solidus temperature $T_s$, liquidus temperature $T_l$ and on $\Delta T_x$ ($=T_x - T_g$).

| Sample | Composition | $T_g$ (° C.) | $T_x$ (° C.) | $\Delta T_x$ (° C.) | $T_s$ (° C.) | $T_l$ (° C.) |
|---|---|---|---|---|---|---|
| 9 | $Ni_{74.4}Cr_2Nb_{3.3}P_{16.5}Si_{0.5}B_{3.3}$ | 399.8 | 436.5 | 36.7 | 832.5 | 898.6 |
| 35 | $Ni_{73.4}Cr_3Nb_{3.3}P_{16.5}Si_{0.5}B_{3.3}$ | 404.1 | 442.2 | 38.1 | 833.4 | 908.8 |
| 36 | $Ni_{72.4}Cr_4Nb_{3.3}P_{16.5}Si_{0.5}B_{3.3}$ | 401.7 | 440.5 | 38.8 | 832.1 | 898.3 |

Figure 16:
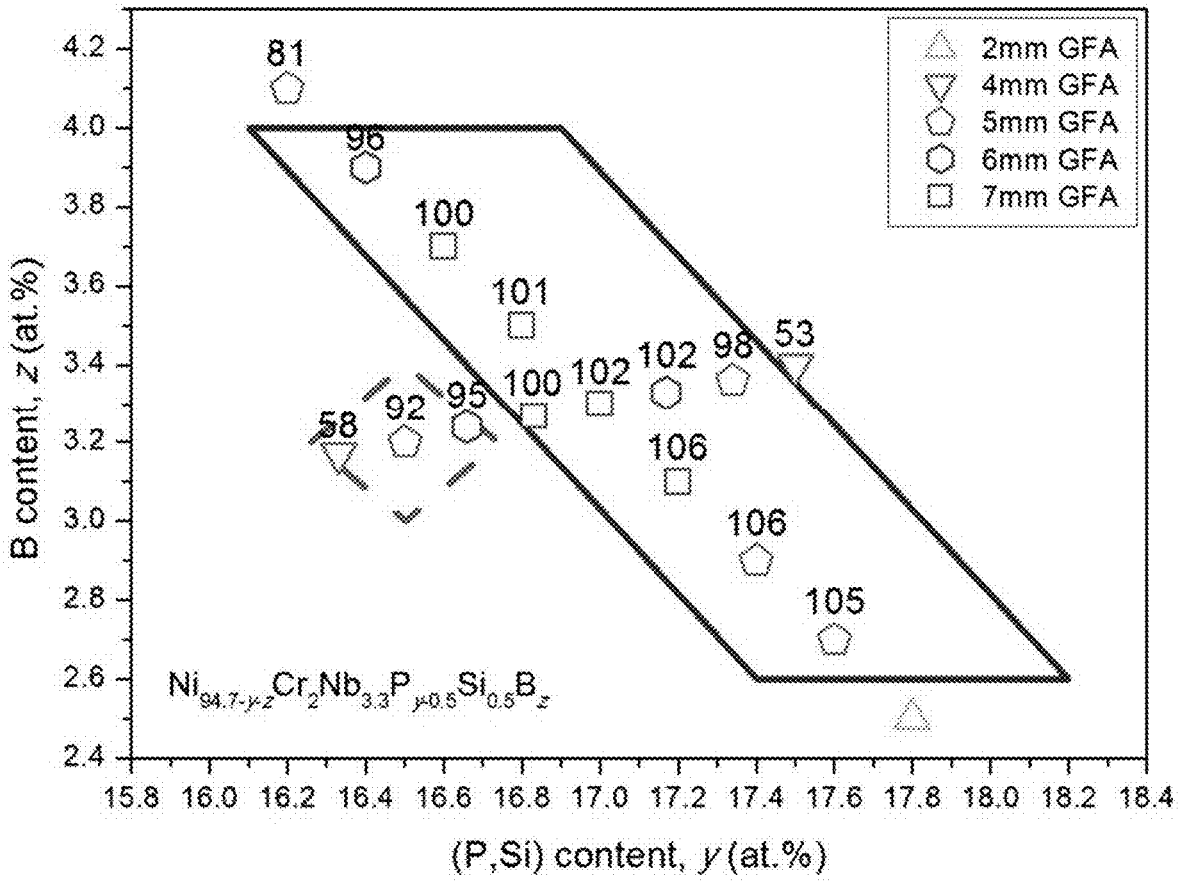
FIG. 16 presents a compositional range plot in two compositional directions, y and z, with y representing the combined atomic concentrations of (P, Si) and x representing the atomic concentration of B, when the atomic concentrations of Cr, Nb, and Si are held constant at 2, 3.3, and 0.5 atomic percent, respectively, according to equation $Ni_{94.7-y-z}Cr_2Nb_{3.3}P_{y-0.5}Si_{0.5}B_z$ in accordance with embodiments of the disclosure.

FIG. 16 presents a compositional range plot in two compositional directions, y and z, representing the contents of (P,Si) and B respectively, when the contents of Cr, Nb, and Si are held constant at 2 atomic percent, 3.3 atomic percent, and 0.5 atomic percent, respectively, according to equation $Ni_{94.7-y-z}Cr_2Nb_{3.3}P_{y-0.5}Si_{0.5}B_z$. The solid line marks the compositional range disclosed in the disclosure, while the dashed line marks the range disclosed in U.S. patent application Ser. No. 13/592,095. The various symbols represent plots of various sample alloys taken from Tables 5 and 7, with the critical rod diameter of each alloy designated by the symbol shape (see inset), and the notch toughness of the metallic glass formed from each alloy (in MPa $m^{1/2}$) given by the number appearing over each symbol.

As seen in FIG. 16, when the contents of Cr, Nb, and Si are held constant at 2 atomic percent, 3.3 atomic percent, and 0.5 atomic percent, respectively, the compositional range for (P,Si) and B disclosed in the disclosure does not overlap with the compositional range disclosed in U.S. patent application Ser. No. 13/592,095. In fact, the (P,Si) and B range disclosed in the current disclosure does not overlap with that in U.S. patent application Ser. No. 13/592,095 at any Cr, Nb, and Si content within the presently disclosed ranges. FIG. 16 also reveals that all example or sample alloys that are within the presently disclosed range have a critical rod diameter of at least 5 mm and the metallic glasses formed from the example alloys have a notch toughness of at least 96 MPa $m^{1/2}$, while all example alloys that are in the range disclosed in U.S. patent application Ser. No. 13/592,095 have a critical rod diameter of at least 5 mm but the metallic glasses formed from the example alloys have a notch toughness of less than 96 MPa $m^{1/2}$.

Figure 17:
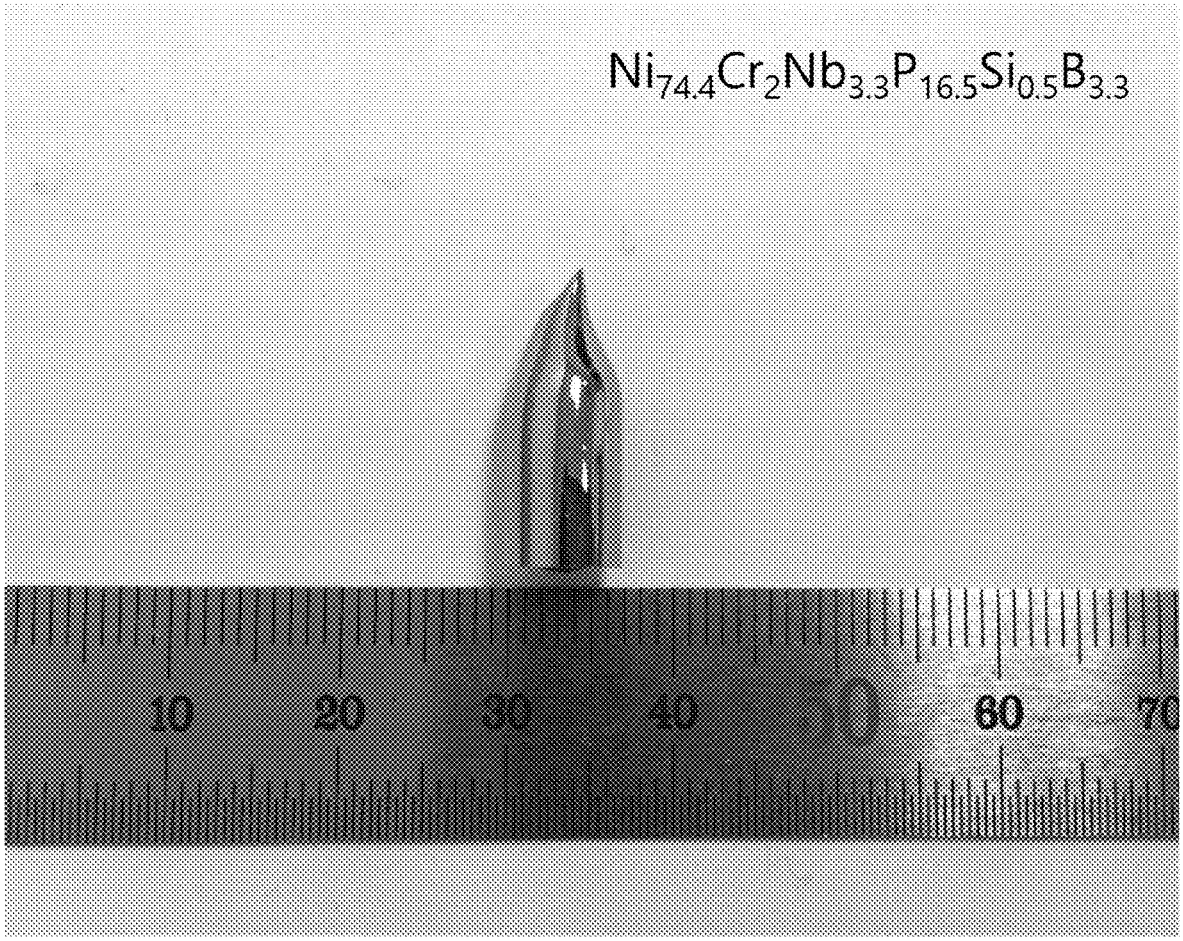
FIG. 17 illustrates a 7 mm rod of metallic glass $Ni_{74.4}Cr_2Nb_{3.3}P_{16.5}Si_{0.5}B_{3.3}$ processed by water quenching the high temperature melt in a fused silica tube having a wall thickness of 1 mm in accordance with embodiments of the disclosure.
Figure 18:
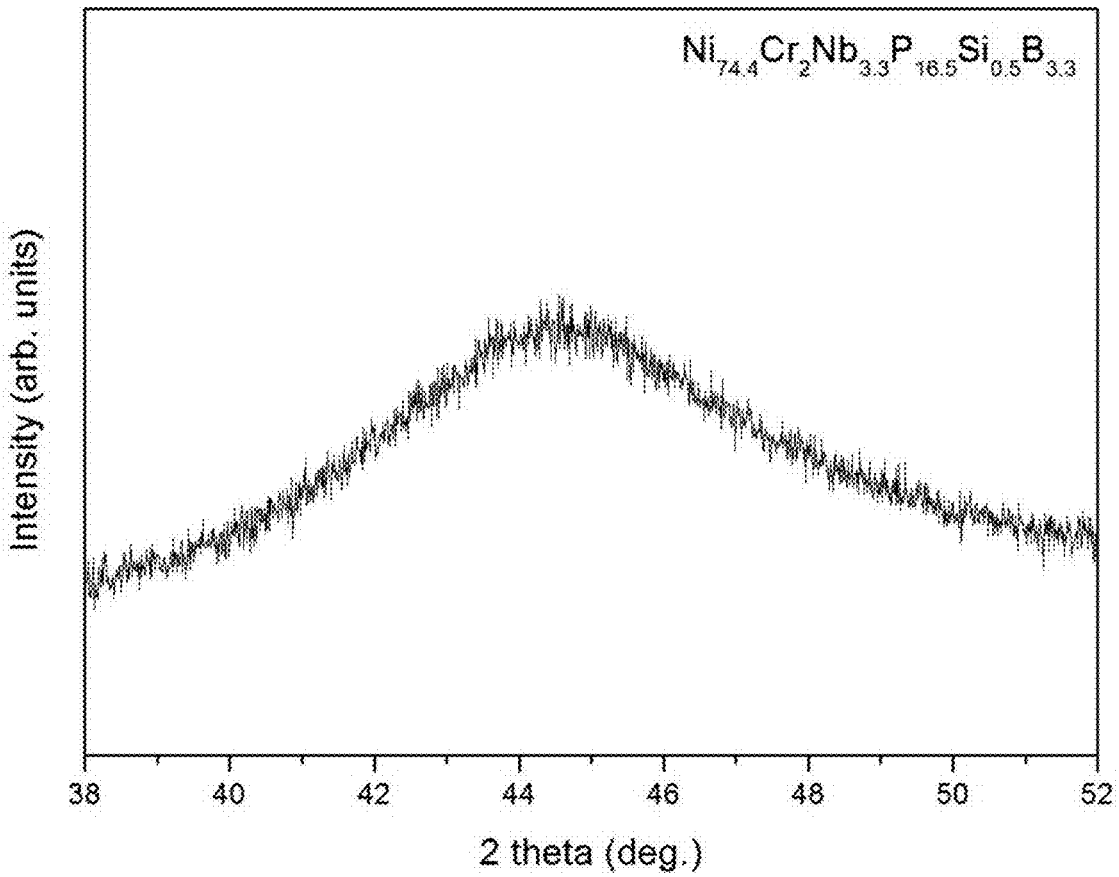
FIG. 18 illustrates an X-ray diffractogram verifying the amorphous structure of a 7 mm rod of sample metallic glass $Ni_{74.4}Cr_2Nb_{3.3}P_{16.5}Si_{0.5}B_{3.3}$ processed by water quenching the high temperature melt in a fused silica tube having a wall thickness of 1 mm in accordance with embodiments of the disclosure.

FIG. 17 illustrates a 7 mm rod of metallic glass $Ni_{74.4}Cr_2Nb_{3.3}P_{16.5}Si_{0.5}B_{3.3}$ processed by water quenching the high temperature melt in a fused silica tube having a wall thickness of 0.5 mm. FIG. 18 illustrates an X-ray diffractogram verifying the amorphous structure of a 7 mm diameter rod of sample metallic glass $Ni_{74.4}Cr_2Nb_{3.3}P_{16.5}Si_{0.5}B_{3.3}$ processed by water quenching the high temperature melt in a fused silica tube having a wall thickness of 0.5 mm.

Description of Methods of Processing the Sample Alloys

The particular method for producing the alloy ingots involves inductive melting of the appropriate amounts of elemental constituents in a quartz tube under inert atmosphere. The purity levels of the constituent elements were as follows: Ni 99.95%, Cr 99.8%, Nb 99.95%, P 99.999%, P 99.9999%, Si 99.9999%, and B 99.5%. The melting crucible may alternatively be a ceramic such as alumina or zirconia, graphite, sintered crystalline silica, or a water-cooled hearth made of copper or silver.

The particular method for producing the rods of sample metallic glasses from the alloy ingots involves re-melting the alloy ingots in quartz tubes having 0.5 mm thick walls in a furnace at 1350° C. under high purity argon and rapidly quenching in a room-temperature water bath. Alternatively, the bath could be ice water or oil. Metallic glass articles could be alternatively formed by injecting or pouring the molten alloy into a metal mold. The mold could be made of copper, brass, or steel, among other materials.

In some embodiments, prior to producing a metallic glass article, the alloyed ingots could be fluxed with a reducing agent by re-melting the ingots in a quartz tube under inert atmosphere, bringing the alloy melt in contact with the molten reducing agent, and allowing the two melts to interact for about 1000 s at a temperature of about 1200° C. or higher, and subsequently water quenching. In one embodiment, the reducing agent is boron oxide.

Test Methodology for Assessing Glass-Forming Ability

The glass-forming ability of each alloy was assessed by determining the maximum rod diameter in which the amorphous phase of the alloy (i.e. the metallic glass phase) could be formed when processed by the methods described above. X-ray diffraction with Cu-Kα radiation was performed to verify the amorphous structure of the alloys.

Test Methodology for Measuring Notch Toughness

The notch toughness of sample metallic glasses was performed on 3-mm diameter rods. The rods were notched using a wire saw with a root radius ranging from 0.10 to 0.13 mm to a depth of approximately half the rod diameter. The notched specimens were placed on a 3-point bending fixture with span of 12.7 mm, and carefully aligned with the notched side facing downward. The critical fracture load was measured by applying a monotonically increasing load at constant cross-head speed of 0.001 mm/s using a screw-driven testing frame. At least three tests were performed, and the variance between tests is included in the notch toughness plots. The stress intensity factor for the geometrical configuration employed here was evaluated using the analysis by Murakimi (Y. Murakami, Stress Intensity Factors Handbook, Vol. 2, Oxford: Pergamon Press, p. 666 (1987)).

Test Methodology for Differential Scanning Calorimetry

Differential scanning calorimetry was performed on sample metallic glasses at a scan rate of 20 K/min to determine the glass-transition and crystallization temperatures of sample metallic glasses formed from the glass-forming alloys, and also determine solidus and liquidus temperatures of the alloys.

The combination of good glass-forming ability and high toughness exhibited by the metallic glasses of the disclosure make the present alloys and metallic glasses excellent candidates for various engineering applications. Among many applications, the disclosed alloys may be used in dental and medical implants and instruments, luxury goods, and sporting goods applications.

The alloys and metallic glasses described herein can also be valuable in the fabrication of electronic devices. An electronic device herein can refer to any electronic device known in the art. For example, it can be a telephone, such as a mobile phone, and a land-line phone, or any communication device, such as a smart phone, including, for example an iPhone®, and an electronic email sending/receiving device. It can be a part of a display, such as a digital display, a TV monitor, an electronic-book reader, a portable web-browser (e.g., iPad®), and a computer monitor. It can also be an entertainment device, including a portable DVD player, conventional DVD player, Blue-Ray disk player, video game console, music player, such as a portable music player (e.g., iPod®), etc. It can also be a part of a device that provides control, such as controlling the streaming of images, videos, sounds (e.g., Apple TV®), or it can be a remote control for an electronic device. It can be a part of a computer or its accessories, such as the hard drive tower housing or casing, laptop housing, laptop keyboard, laptop track pad, desktop keyboard, mouse, and speaker. The article can also be applied to a device such as a watch or a clock.

Having described several embodiments, it will be recognized by those skilled in the art that various modifications, alternative constructions, and equivalents may be used without departing from the spirit of the disclosure. Those skilled in the art will appreciate that the presently disclosed embodiments teach by way of example and not by limitation. Therefore, the matter contained in the above description or shown in the accompanying drawings should be interpreted as illustrative and not in a limiting sense. Additionally, a number of well-known processes and elements have not been described in order to avoid unnecessarily obscuring the disclosure.

The following claims are intended to cover all generic and specific features described herein, as well as all statements of the scope of the present method and system, which, as a matter of language, might be said to fall therebetween.

What is claimed is:

1. A metallic glass formed of an alloy represented by the following formula (subscripts w, x, y, and z denote deviations from a nominal concentration in atomic percentages, while a denotes an atomic fraction):

$$Ni_{(95-w-x-y-z)}Cr_{2+w}Nb_{3+x}(P_{1-a}Si_a)_yB_z \quad \text{Eq. (1)}$$

$-1.5 \le w < 0.5$;

$-0.5 \le x \le 1$;

$2.6 \le z \le 4$;

$20.2+0.2w-0.65|x|-z \le y \le 20.8-z$;

$0 \le a \le 0.1$;

wherein a critical rod diameter of the alloy is at least 5 mm; and wherein a notch toughness of the metallic glass averaged over at least three measurements is at least 96 MPa $m^{1/2}$.

2. The metallic glass of claim 1, wherein $-1 \le w < 0.4$.

3. The metallic glass of claim 1, wherein $-0.4 \le x \le 0.8$.

4. The metallic glass of claim 1, wherein $2.8 \le z \le 3.8$.

5. The metallic glass of claim 1, wherein $20.2+0.2w-0.65|x|-z \le y \le 20.7-z$.

6. The metallic glass of claim 1, wherein the atomic concentration of B is less than 3.8 percent and the notch toughness of the metallic glass is at least 100 MPa $m^{1/2}$.

7. The metallic glass of claim 1, wherein the atomic concentration of metalloids is in the range of 20 to 20.7 percent and the notch toughness of the metallic glass is at least 100 MPa $m^{1/2}$.

8. A metallic glass formed of an alloy consisting of:

Cr in an atomic percent of 2 with a variance w of from −1.5 to less than 0.4;

Nb in an atomic percent of 3 with a variance x of from −0.5 to 0.9;

B in an atomic percent z ranging from 2.6 to 3.9;

P and optionally Si, wherein the combined P and Si atomic percent ranges from $20.2+0.2w-0.65|x|-z$ to $20.8-z$, wherein the atomic fraction of Si in the combined P and Si atomic percent ranges from 0 to 0.1;

wherein the balance is Ni and incidental impurities;

wherein a critical rod diameter of the alloy is at least 5 mm; and wherein a notch toughness of the metallic glass averaged over at least three measurements is at least 96 MPa $m^{1/2}$.

9. The metallic glass of claim 1, wherein the metallic glass is selected from a group consisting of $Ni_{74.8}Cr_2Nb_{2.9}P_{16.75}Si_{0.25}B_{3.3}$, $Ni_{74.8}Cr_2Nb_{2.9}P_{16.5}Si_{0.5133.3}$, $Ni_{74.8}Cr_2Nb_{2.9}P_{16.25}Si_{0.75}B_{3.3}$, $Ni_{75}Cr_2Nb_{2.7}P_{16.5}Si_{0.5}B_{3.3}$, $Ni_{74.6}Cr_2Nb_{3.1}P_{16.5}Si_{0.5}B_{3.3}$, $Ni_{74.4}Cr_2Nb_{3.3}P_{16.5}Si_{0.5}B_{3.3}$, $Ni_{74.2}Cr_2Nb_{3.5}P_{16.5}Si_{0.5}B_{3.3}$, $Ni_{74}Cr_2Nb_{3.7}P_{16.5}Si_{0.5}B_{3.3}$, $Ni_{73.8}Cr_2Nb_{3.9}P_{16.5}Si_{0.5}B_{3.3}$, $Ni_{74.4}Cr_2Nb_{3.3}P_{17.1}Si_{0.5}B_{2.7}$, $Ni_{74.4}Cr_2Nb_{3.3}P_{16.9}Si_{0.5132.9}$, $Ni_{74.4}Cr_2Nb_{3.3}P_{16.7}Si_{0.5}B_{3.1}$, $Ni_{74.4}Cr_2Nb_{3.3}P_{16.3}Si_{0.5}B_{3.5}$, $Ni_{74.4}Cr_2Nb_{3.3}P_{16.1}Si_{0.5}B_{3.7}$, $Ni_{74.4}Cr_2Nb_{3.3}P_{15.9}Si_{0.5}B_{3.9}$, $Ni_{74.21}Cr_2Nb_{3.29}P_{16.66}Si_{0.51}B_{3.33}$, $Ni_{74.03}Cr_{1.99}Nb_{3.28}P_{16.83}Si_{0.51}B_{3.36}$, $Ni_{75.4}Cr_1Nb_{3.3}P_{16.5}Si_{0.5}B_{3.3}$, $Ni_{74.9}Cr_{1.5}Nb_{3.3}P_{16.5}Si_{0.5}B_{3.3}$, and $Ni_{74.4}Cr_2Nb_{3.3}P_{16.5}Si_{0.5}B_{3.3}$.

10. A method for forming an article of a metallic glass comprising an alloy of claim 1, the method comprising:

melting the alloy to form a molten alloy; and subsequently quenching the molten alloy at a cooling rate sufficiently high to prevent crystallization of the alloy.

* * * * *